US007740291B2

(12) United States Patent
Baser

(10) Patent No.: US 7,740,291 B2
(45) Date of Patent: Jun. 22, 2010

(54) DOOR HANDLE ASSEMBLY

(76) Inventor: Owen Baser, 901 Piedmont Dr., Sacramento, CA (US) 95822

( * ) Notice: Subject to any disclaimer, the term of this patent is extended or adjusted under 35 U.S.C. 154(b) by 611 days.

(21) Appl. No.: 11/675,874

(22) Filed: Feb. 16, 2007

(65) Prior Publication Data

US 2007/0182164 A1 Aug. 9, 2007

Related U.S. Application Data

(63) Continuation-in-part of application No. 11/307,908, filed on Feb. 27, 2006, now Pat. No. 7,296,829, which is a continuation-in-part of application No. 10/816,061, filed on Mar. 31, 2004, now Pat. No. 7,004,518, which is a continuation-in-part of application No. 10/213,135, filed on Aug. 5, 2002, now Pat. No. 6,722,716.

(60) Provisional application No. 60/318,478, filed on Sep. 10, 2001.

(51) Int. Cl.
*E05C 1/12* (2006.01)
*E05B 3/00* (2006.01)

(52) U.S. Cl. ..... 292/173; 292/163; 292/336.3

(58) Field of Classification Search ..... 292/163, 292/173, 336.3
See application file for complete search history.

(56) References Cited

U.S. PATENT DOCUMENTS

| | | | | | |
|---|---|---|---|---|---|
| 2,260,125 | A * | 10/1941 | Prance | 292/347 |
| 3,209,563 | A * | 10/1965 | Pelcin | 70/489 |
| 3,698,215 | A * | 10/1972 | Truhon | 70/152 |
| 4,138,869 | A * | 2/1979 | Pelcin | 70/151 R |
| 4,231,597 | A * | 11/1980 | Pelcin | 292/164 |
| 4,480,451 | A * | 11/1984 | Fujiya | 70/92 |
| 5,085,474 | A * | 2/1992 | Toledo et al. | 292/92 |
| 6,666,053 | B2 * | 12/2003 | Sadler | 70/210 |

* cited by examiner

*Primary Examiner*—Carlos Lugo
(74) *Attorney, Agent, or Firm*—Ian F. Burns & Associates, P.C.

(57) ABSTRACT

In at least one embodiment, a door handle assembly is provided. The door handle assembly includes a door handle and a mount. The door handle can be attached to the mount. The door handle is adapted to allow a bolt to move into and out of a wall aperture. A cam assembly is disposed adjacent the bolt. The cam assembly includes a locking cam. The locking cam is adapted to abut at least a portion of the bolt. The locking cam is moveable between a locked and an unlocked position. A lock release mechanism is coupled to the cam assembly and to the door handle. The lock release mechanism is adapted to disengage the locking cam from the bolt when the door handle is actuated such that the bolt is free to move.

19 Claims, 34 Drawing Sheets

DOOR HANDLE ASSEMBLY

CROSS REFERENCE TO RELATED AND CO-PENDING APPLICATIONS

This application is a continuation in part of U.S. application Ser. No. 11/307,908, filed Feb. 27, 2006, now U.S. Pat. No. 7,296,829 (Nov. 20, 2007), which is a continuation in part of U.S. application Ser. No. 10/816,061, filed Mar. 31, 2004, now U.S. Pat. No. 7,004,518 (May 28, 2006, which is a continuation in part of U.S. application Ser. No. 10/213,135, filed Aug. 5, 2002, now U.S. Pat. No. 6,722,716 (Apr. 20, 2004). That application claims the benefit of and incorporates by reference, U.S. provisional application No. 60/318,478, filed on Sep. 10, 2001.

FIELD OF THE INVENTION

The present invention relates to door handle assemblies. More particularly, the present invention relates to low-profile door handle assemblies having door handles actuated by a non-rotational motion.

BACKGROUND

Conventional door handle assemblies typically include a pair of faceplates, a slide bolt, and a pair of door handles. The slide bolt is assembled inside a standard bore of a door so that when the slide bolt extends, it engages the door to an aperture in a wall thereby closing the door and allowing the door to be locked. The standard bore is covered by two opposing faceplates. The door handles protrude from the faceplates.

The height of a conventional door handle is typically 2.25 to 2.50 inches, as measured from a door surface. A conventional door often damages a wall, especially when a door is slammed into a wall. A wall can also be gradually damaged when a conventional door handle often contacts the wall. To minimize wall damage, people use devices, such as doorstops and rubber pads attached to the walls. However, doorstops and rubber pads are not aesthetically pleasing to some people. Doorstops and rubber pads also require additional cost, time, and effort to install. Additionally, doorstops and rubber pads leave permanent marks or holes on the wall when removed. Thus, a door handle that does not cause wall damage is desired.

Another problem with a conventional door handle assembly is it requires rotation of the handle to open a door. Rotating a door handle is difficult at times, particularly when carrying an object with both hands, or particularly when the user is elderly, physically challenged, or has wrist problems. Thus, a door handle assembly that allows a user to open a door without having to rotate the door handle is also desired.

A number of door handles and door handle assemblies are available. U.S. Pat. No. 2,260,125 ('125) discloses a low-profile handle assembly designed for automobiles. The handle assembly has a large disk-like plate. The front face of the disk-like plate is recessed and attaches a crossbar spanning across the recess. The crossbar has an offset projection at one of its ends to provide a finger piece for the handle assembly.

A user would use the finger piece as a crank for raising and lowering the glass panels in windows. A user would also use the finger piece as a handhold or grip for use and assistance in closing the vehicle door. The problem with '125 is it only provides a handhold for opening or closing a door. The handhold does not actuate a lock or a slide bolt.

U.S. Pat. No. 5,085,474 ('474) discloses a latch opener of the push-pull type. '474 has a base plate secured to a door. A handle is mounted on the base plate to pivot about a first axis. The handle is attached to an actuator. The actuator is mounted on the base plate to pivot about a second axis perpendicular to the first axis. The actuator includes a projecting arm engageable in an opening of a latch bolt housing. When the arm engages a latch bolt, the arm causes the latch bolt to slide and thereby allowing the door to open. The latch bolt housing has a coil spring to continuously bias the latch bolt into a position protruding out of the door thereby allowing the door to close. The problem with '474 is that its handle protrudes in a manner that can cause wall damage. Additionally, its actuator is composed of multiple parts, which makes the actuator susceptible to mechanical malfunction and which makes the actuator expensive to manufacture.

ADVANTAGES OF ONE OR MORE EMBODIMENTS OF THE PRESENT INVENTION

The various embodiments of the present invention may, but do not necessarily, achieve one or more of the following advantages:

provide a low-profile door handle;

provide a door handle substantially flush with a faceplate cover;

provide an attractive door handle;

provide a door handle assembly that opens a door by a non-rotational motion;

provide a door handle assembly that allows a user to open a door easily;

provide a bolt constructed with unitary piece of material;

provide a bolt constructed with minimum machining;

provide a bolt that makes a sturdy and secure door lock;

provide a door handle assembly that is easy to install;

provide a door lock with an emergency access;

provide a door handle assembly with minimal components;

the ability to minimize wall damage from a door handle;

prove a door handle that may be operated with minimal force; and provide a door handle that can be easily pushed to open a door.

provide a door lock that can be released by actuating a door handle.

provide a lock release that can open a locked door when the door handle is moved.

These and other advantages may be realized by reference to the remaining portions of the specification, claims, and abstract.

BRIEF SUMMARY OF THE ASPECTS OF THE INVENTION

In at least one embodiment, a door handle assembly is provided. The door handle assembly includes a door handle and a mount. The door handle can be attached to the mount. The door handle is adapted to allow a bolt to move into and out of a wall aperture. A cam assembly is disposed adjacent the bolt. The cam assembly includes a locking cam. The locking cam is adapted to abut at least a portion of the bolt. The locking cam is moveable between a locked and an unlocked position. A lock release mechanism is coupled to the cam assembly and to the door handle. The lock release mechanism is adapted to disengage the locking cam from the bolt when the door handle is actuated such that the bolt is free to move.

Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

Certain embodiments of the invention are shown in the following drawings where:

FIG. 37 shows a door with the door handle assembly attached.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
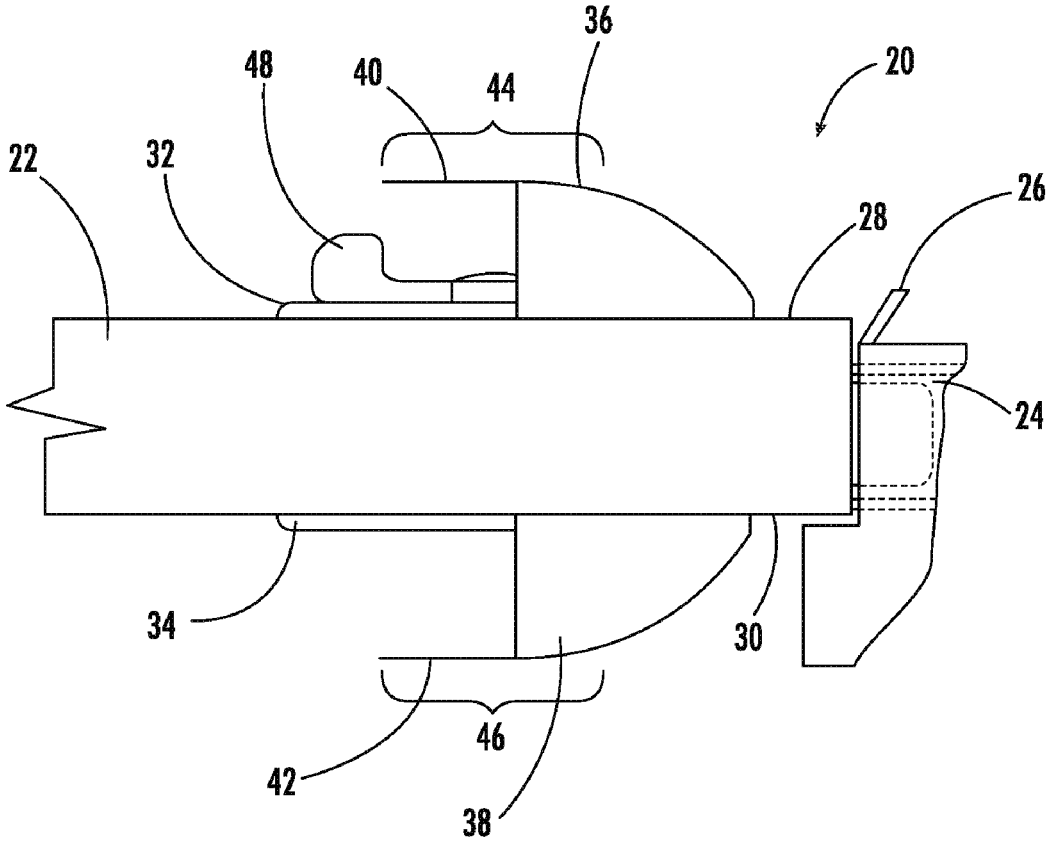
FIG. 1 is substantially a top plan view of one embodiment of the door handle assembly of the present invention being attached to a door, the door handle assembly having a handle and a faceplate cap on each side of the door, and the handle and the faceplate cap on each side of the door defining a substantially flush and a substantially flat surface.

The present invention comprises a door handle assembly, generally indicated by reference number 20. Referring to FIG. 1, door handle assembly 20 is preferably configured to attach to a door 22. Door 22 is engageable to a wall recess 24 preferably covered by a striker plate 26. Door 22 has a front side 28 and a backside 30. Front side 28 is preferably distinguishable from backside 30 by front side 30 being the side to which striker plate 26 protrudes.

In the preferred embodiment, door handle assembly 20 has a pair of opposing faceplates 32 and 34, a pair of opposing faceplate caps 36 and 38 attached to their corresponding faceplates, and a pair of opposing handles 40 and 42. Faceplate cap 36 and handle 40 define a substantially flush and flat surface 44 on front side 28. Faceplate cap 38 and handle 42 define a substantially flush and flat surface 46 on backside 30. In the most preferred embodiment, door handle assembly 20 also has a cam handle 48.

Figure 2:
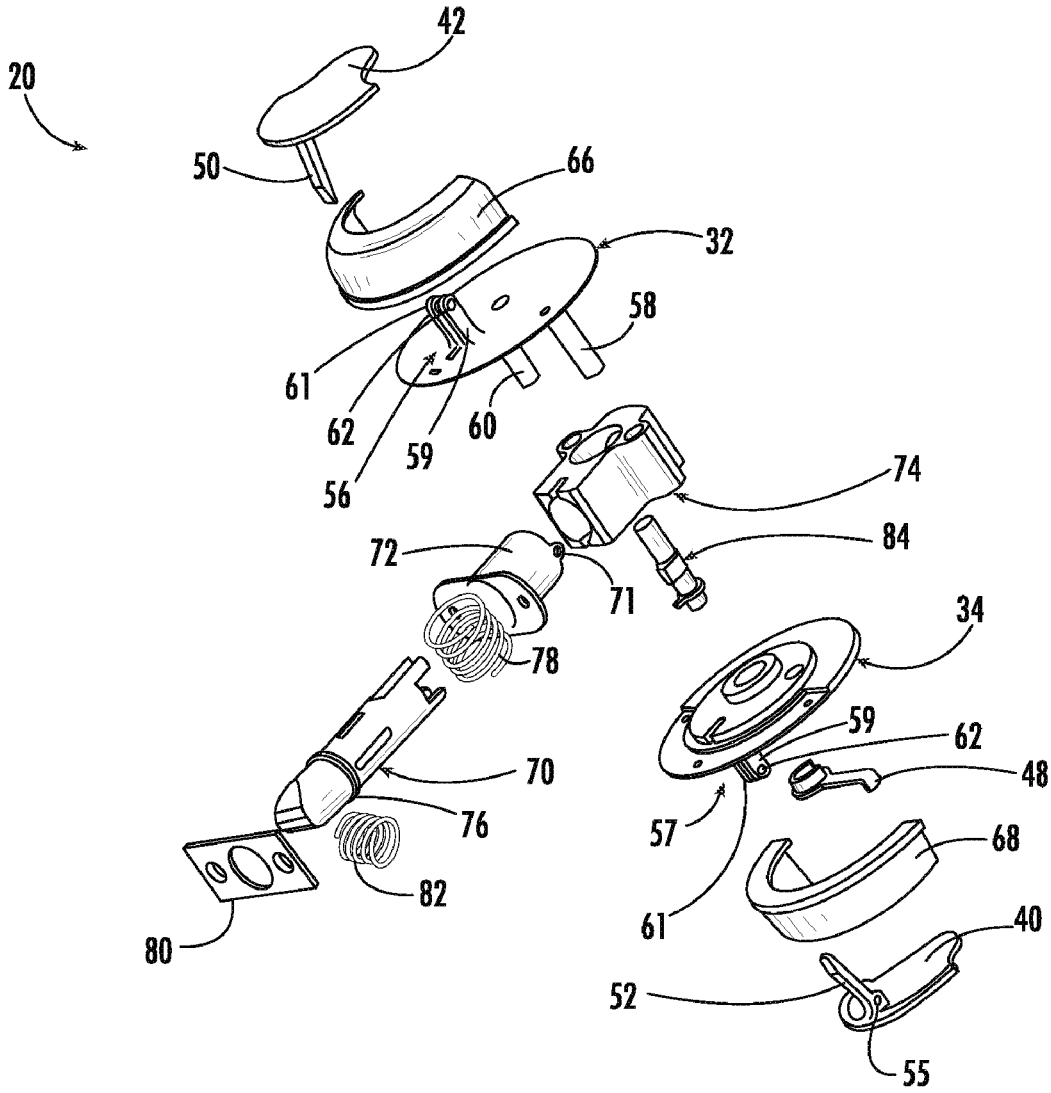
FIG. 2 is substantially an exploded view of one embodiment of the door handle assembly of the present invention.

Referring now to FIG. 2, the preferred embodiment of door handle assembly 20 has an actuator 50 attached to handle 42 and an actuator 52 attached to handle 40. Each actuator 50 and 52 preferably has a pin passage 55 adjacent to its corresponding handle. A fastener (not shown) known in the art may be used to pivotably or rotatably attach actuators 50 and 52 to their corresponding actuator mount 56 and 57.

Actuator mounts 56 and 57 are preferably similar, and they are preferably made of two opposing and parallel projections 59 and 61 being spaced apart. Each actuator mount 56 and 57 preferably has a fastener opening 62 defined by their projections 59 and 61, preferably at the ends of each projections 59 and 61. To attach actuators 50 and 52 to their actuator mounts 56 and 57, respectively, each actuator 50 and 52 is placed in between the parallel projections 59 and 61 of their corresponding actuator mount 56 and 57. A fastener (not shown in FIG. 1) is inserted through fastener opening 61, fastener passage 55, and fastener opening 62.

The ends of parallel projections 59 and 61 of each actuator mounts 56 and 57 that are distal from fastener opening 62 are attached perpendicular to faceplates 32 and 34. Faceplates 32 and 34 are attachable to each other through parallel posts 58 and 60. Faceplate caps 66 and 68 are attached to faceplates 32 and 34, respectively.

Door handle assembly 20 may further have a bolt 70. Bolt 70 is preferably configured to be positioned inside a bolt collar 72. Bolt collar 72 and bolt 70 are preferably configured to be positioned inside a bolt housing 74. Bolt 70 preferably has a bolt ring 76. A first biasing device 78, preferably a spring, may be positioned in between bolt ring 76 and bolt collar 72. Bolt collar 72 is preferably configured to attach to a bolt plate 80 by using fasteners known in the art, such as a screw. A second biasing device 82, preferably a spring, may be positioned in between bolt ring 76 and bolt plate 80. Biasing devices 78 and 80 may also be made of other materials known in the art, such as a coil spring or a tension spring.

Door handle assembly 20 may further have a cam 84 configured to extend across and perpendicular to the planes of faceplates 32 and 34. Cam 84 is further configured to be positioned inside bolt housing 74 and perpendicular to the sliding axis of bolt 70.

Faceplates

Figure 3:
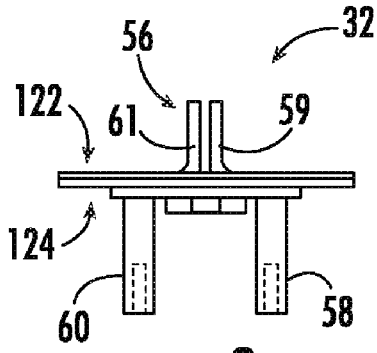
FIG. 3 is substantially an elevational view of one embodiment of a faceplate of the present invention.

Faceplates 32 and 34 are preferably made of zinc metal, but may be made of other materials known in the art such as brass, zinc alloy, or steel. An embodiment of one of the faceplates of door handle assembly 20 is shown in FIGS. 3-6. Faceplate 32 is preferably configured to attach to front side 28 of door 22 (shown in FIG. 1). Referring now to FIG. 3, faceplate 32 has a front side 122 and a backside 124. Front side 122 forms the exterior side of faceplate 32, which is the visible side when faceplate 32 is attached to a door. An actuator mount 56 is attached to front side 122 of faceplate 32. Actuator mount 56 preferably has two parallel projections 59 and 61. Backside 124 forms the interior side of faceplate 32, which will not be visible when faceplate 32 is attached to a door. Faceplate 32 has two parallel posts 58 and 60 attached to backside 55. The ends of posts 58 and 60 that are not directly attached to backside 124 preferably have hollow ends, which may further have threaded interiors to accommodate threaded screws for attaching an opposing faceplate.

Figure 4:
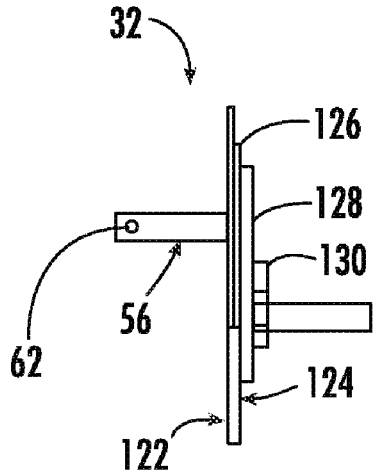
FIG. 4 is substantially a side view of the embodiment of the faceplate shown in FIG. 3.
Figure 5:
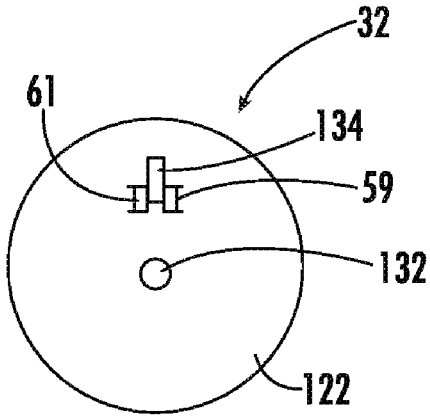
FIG. 5 is substantially a plan view of the front side of the faceplate embodiment shown in FIG. 3.

Referring now to FIG. 4, actuator mount 56 preferably defines a fastener passage 62. Fastener passage 62 allows a pin or a fastener known in the art to attach an actuator to actuator mount 56. As shown also in FIG. 4, backside 124 preferably has three concentric layers 126, 128, and 130. Referring now to FIG. 5, front side 122 has a circular cam opening 132 preferably substantially in the middle of front side 122. Circular cam opening 132 allows cam (not shown in FIG. 5) to attach to faceplate 32.

Figure 6:
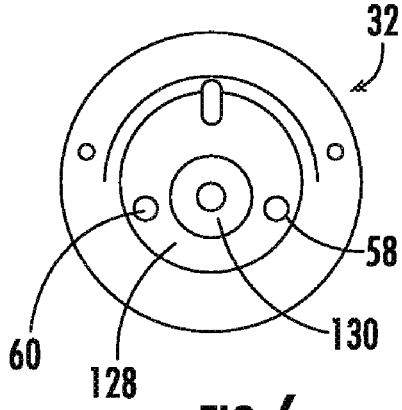
FIG. 6 is substantially a plan view of the backside of the faceplate embodiment shown in FIG. 3.

Front side 122 further has an oblong actuator passage 134. Actuator passage 134 is positioned between parallel projections 59 and 61. Of course, the positions, shapes, and sizes of actuator passage 134 and cam opening 132 may vary. Referring now to FIG. 6, actuator passage 134 preferably extends through layer 128. Posts 58 and 60 are preferably attached on layer 128.

Figure 7:
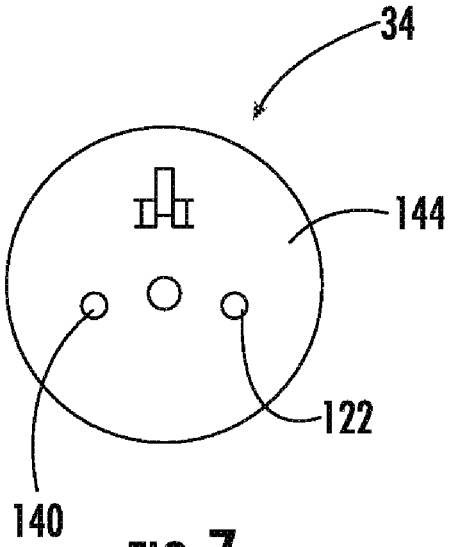
FIG. 7 is substantially a plan view of the front side of another faceplate embodiment.

Another embodiment of faceplate is shown in FIGS. 7-10. Faceplate 34 is preferably configured to attach to back side 30 of door 22 (shown in FIG. 1). Faceplate 34 is preferably similar to faceplate 32 (shown in FIGS. 3-6). However, faceplate 34 preferably does not have posts attached to the backside of the faceplate unlike faceplate 32. Referring to FIG. 7, faceplate 34 preferably has fastener openings 140 and 142 drilled on backside 124 so that when faceplates 32 and 34 are attached to a door, opposing faceplates 32 and 34 are connected by fasteners, such as screws, through fastener openings 140 and 142 of faceplate 34 and posts 58 and 60 of faceplate 32.

Figure 8:
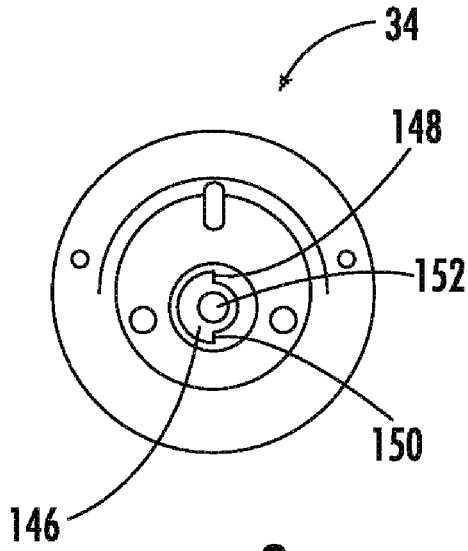
FIG. 8 is substantially a plan view of the backside of the faceplate embodiment shown in FIG. 7.

Referring now to FIG. 8, faceplate 34 also has three concentric layers like faceplate 32. However, in the preferred embodiment, faceplate 34 has an additional fourth layer 146. Fourth layer 146 preferably defines cam stops 148 and 150, and thus fourth layer 146 is preferably circular shaped having a larger radius on one side than the other. Fourth layer 146 preferably further defines a cam opening 152. Cam opening 152 is configured to receive cam 105 (not shown in FIG. 8). When cam 105 (not shown in FIG. 8) attaches to fourth layer 146 through cam opening 152 and rotates, the axis of rotation of cam 105 will be limited by cam stops 148 and 150.

Faceplate Caps

Figure 9:
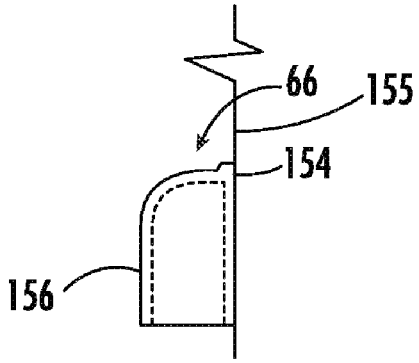
FIG. 9 is substantially a side view of an embodiment of a faceplate cap of the present invention.

Referring now to FIG. 9, an embodiment of a faceplate cap 66 is shown. Faceplate caps 66 and 68 (shown in FIG. 1) are preferably similar. Faceplate cap 66 is preferably made of zinc metal, but may be made of other materials known in the art, such as brass, zinc alloy, or steel. Faceplate cap 66 has preferably a hemisphere shape further cut crosswise by a half. Faceplate cap 66 has a backside 154 and a front side 156. The preferred distance from backside 154 and front side 156 is equal to or less than 1 inch. When measured from a door surface 155, the preferred height of faceplate cap 66 is equal to or less than 1 inch. Of course, the faceplate cap may be made with varying dimensions.

Figure 10:
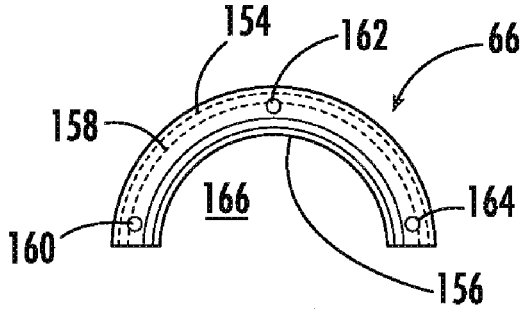
FIG. 10 is substantially a plan view of the faceplate cap embodiment shown in FIG. 9.

As shown in FIG. 10, backside 154 preferably has flat base 158 configured to attach to a faceplate (not shown in FIG. 10). Flat base 158 preferably has three openings 160, 162, and 164 for fasteners, such as screws, to attach faceplate cap 66 to a faceplate (not shown in FIG. 10). Of course, flat base 158 may be attached to a faceplate by welding, by using an adhesive, or other techniques known in the art. Front side 156 preferably defines a semi-circular recess 166, which accommodates handle 40 or 42 (not shown in FIG. 10). Front side 156 and handle 40 or 42 forms a substantially flat surface (not shown in FIG. 10).

Faceplate cap 66 may be made of shapes other than a hemisphere that is further cut by a half. Faceplate cap 66 may be in the shape of an entire hemisphere, a hemisphere cut by more than or less than a half, or some portion of a sphere cut crosswise by exactly a half, more than a half, or less than a half.

Figure 11:
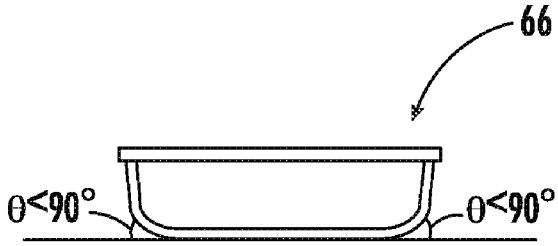
FIG. 11 is substantially a cross-sectional view of the faceplate cap embodiment shown in FIG. 9 with the front side being on the bottom and the backside being on top.

As shown in FIG. 11, when faceplate cap 66 is laid on a flat surface with front side 58 on the bottom and backside 56 on top, the edges of front side 58 forms substantially an acute angle measured from the flat surface.

Door Handles and Actuator

Figure 12:
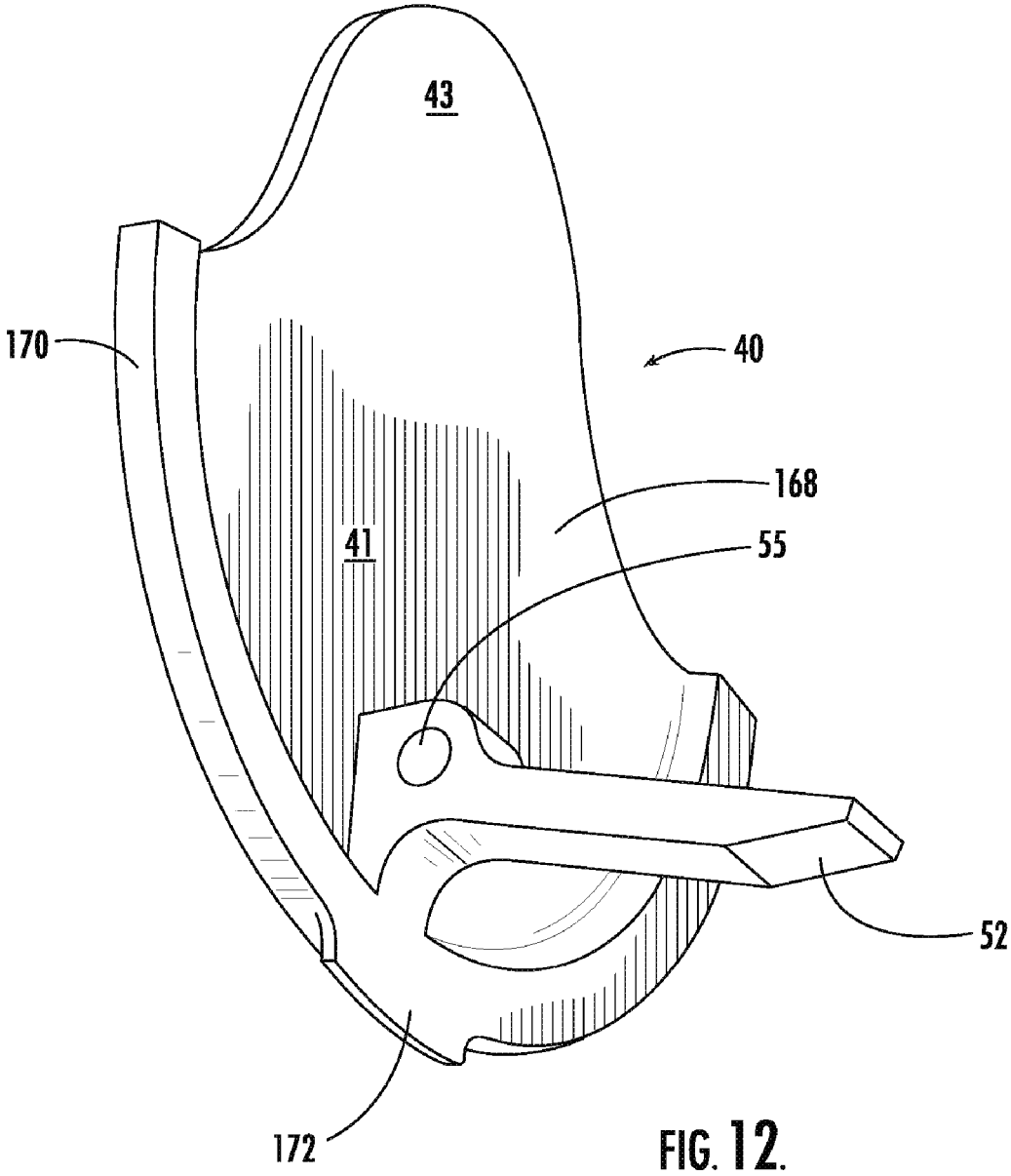
FIG. 12 is substantially a perspective view of an embodiment of a door handle and an actuator of the present invention.

Referring now to FIG. 12, a handle 40 with an attached actuator 52 is shown. Handle 42 shown in FIG. 2 is preferably similar to handle 40. Actuator 52 shown in FIG. 2 is preferably similar to actuator 50. Handle 40 has a front surface (not shown in FIG. 12) and a back surface 168. Handle 40 preferably has a semi-circular shaped half 41. The other half of handle 40 is preferably a substantially c-shaped half 43, wherein the ends of the "c" are smoothly connected to semi-circular shaped half 41. C-shaped half 43 allows a user to easily grasp and pull handle 40.

Semi-circular shaped half 41 preferably has raised edges 170 to add more definition to handle 40. Handle 40 preferably has a pivot stop 172 attached in the middle of raised edge 170 of semi-circular shaped half 41 and adjacent to back surface 168. Pivot stop 172 may be made of various shapes. Pivot stop 172 preferably protrudes from raised edge 170 and is preferably parallel to the plane of raised edge 170. Pivot stop 172 restricts the pivot movement of handle 40.

When handle 40 is attached on actuator mount 56 (not shown in FIG. 12) and adjacent to faceplate cap 66 (not shown in FIG. 12), handle 40 and faceplate cap 66 are preferably configured to form a substantially flush and substantially flat front surface.

Actuator 52 is preferably attached on backside 168 of handle 40 and perpendicular to handle 40. Actuator 52 is preferably positioned adjacent to the middle of the rounded edge of semi-circular half 41 of handle 40. Actuator 52 preferably defines pin passage 55 adjacent to the end of actuator 52 that is adjacent to handle 40. The opposite end of actuator 52 that is away from handle 40 is preferably tapered on one side to allow for better positioning of actuator 52 inside actuator passage of bolt 70 (not shown in FIG. 12).

Handle 40 and actuator 52 are preferably made of zinc, but may be made with other materials known in the art, such as steel, zinc alloy, and brass. In the preferred embodiment, handle 40 and actuator 52 are unitarily built. However, handle 40 and actuator 52 may also be attached through welding or through an adhesive. Handle 40 and actuator 52 may further be attached using fasteners known in the art.

Bolt

Figure 13:
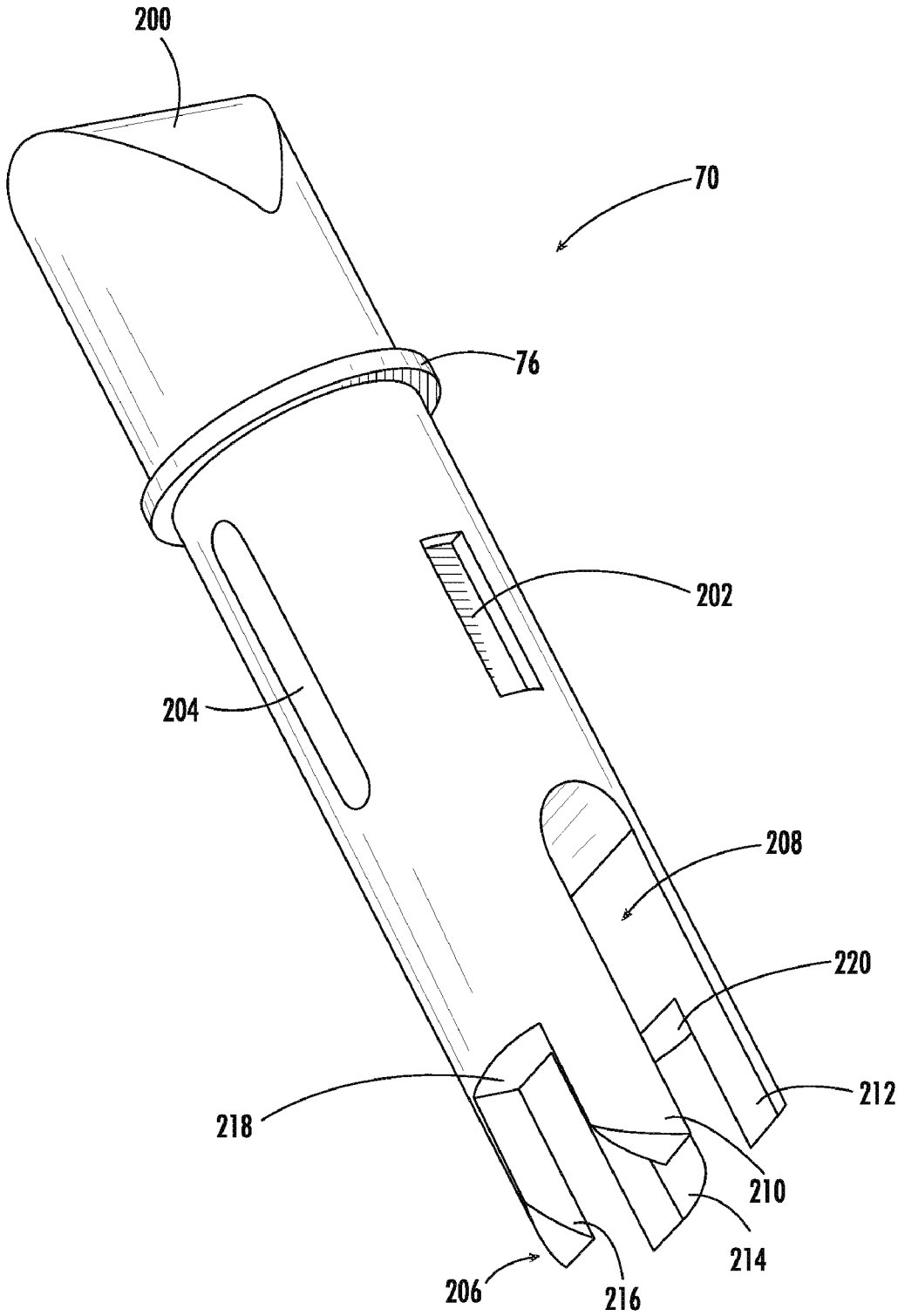
FIG. 13 is substantially a perspective view of an embodiment of a bolt of the present invention.

Referring now to FIG. 13, a preferred embodiment of bolt 70 is shown. In the preferred embodiment, bolt 70 partially tapers toward a first end 200. First end 200 is configured to insert through a wall aperture to engage and close a door. First end 200 is tapered so that when first end 200 is in contact with a striker plate surrounding a wall aperture (not shown in FIG. 13), first end 200 slides past striker plate, and first end 200 slides towards inside the wall aperture. First end 200 is also tapered to allow bolt 70 to move outside the wall aperture quicker when the door is opened.

In the preferred embodiment, bolt 70 also has a pin opening 204. One end of a pin (not shown) may be inserted inside pin opening 204 and the other end of pin may be attached to a pin opening 71 of bolt collar 72 (shown in FIG. 2), and thus the pin prohibits substantial rotational movement of bolt 70. Prohibiting substantial rotational movement of bolt 70 may allow proper actuator positioning inside actuator opening 202, which translates to proper operation of actuators 52 and 50 (not shown in FIG. 13).

In the preferred embodiment, bolt 70 has a ring 76. Ring 76 provides an abutting surface for biasing devices 78 and 82 (shown in FIG. 2) so that biasing devices 78 and 82 can operate to cause bolt 70 to slide back and forth in a sliding axis thereby allowing bolt to engage and disengage a door from a wall aperture. Bolt 70 has a second end 206, which is opposite first end 200. Bolt 70 defines a cam aperture 208 adjacent to the second end. Cam aperture 208 is configured to accommodate cam 105 (not shown in FIG. 13) positioned perpendicular to bolt 70. At the second end, bolt 70 has a plurality of fingers 210, 212, 214, and 216. Fingers 210, 212, 214, and 216 define a pair of stop surfaces 218 and 220 for a cam portion (not shown in FIG. 13) to abut to prevent bolt from sliding in its sliding axis.

Bolt 70 is preferably made of zinc, but may also be made of materials known in the art, such as zinc alloy, steel, and brass. Bolt 70 is preferably unitarily constructed. Bolt 70 may unitarily be constructed by molding or other techniques known in the art. A unitarily constructed bolt 70 provides a sturdier and thus more secure lock than a bolt made of multiple components. A lock provided by a bolt made of multiple components may easily be tampered. For example, if one component gives in to the tampering or if the component bends or breaks, the remaining components may lose the support provided by the component that gave in. In contrast, for a lock supported by a unitarily constructed bolt to be tampered, the entire bolt has to be destroyed. Since bolt 70 is usually positioned inside a standard bore of a door, tampering with bolt 70 may require destruction of the entire door.

Bolt Housing

Figure 14:
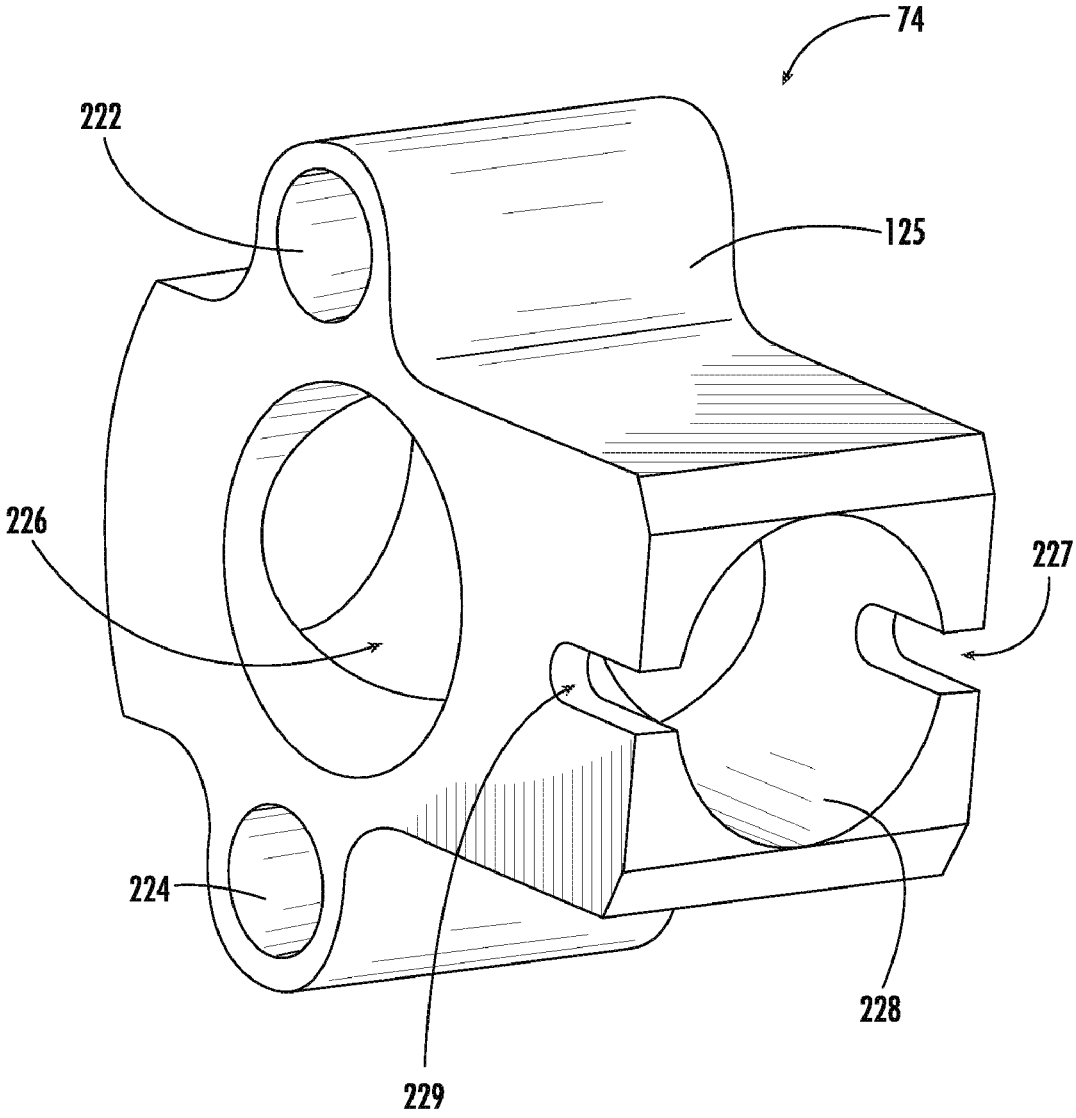
FIG. 14 is substantially a perspective view of an embodiment of a bolt housing of the present invention.

Referring now to FIG. 14, an embodiment of a bolt housing is shown. Bolt housing 74 preferably defines post passages 222 and 224. Post passages 222 and 224 are designed to receive posts 58 and 60 of faceplate 32 (not shown in FIG. 14). Bolt housing 74 further defines a cam passage 226 in between post passages 222 and 224. Cam passage 226 is designed to allow cam 105 (not shown in FIG. 14) to extend between faceplates 32 and 34 (also not shown in FIG. 14). Next, bolt housing 74 defines a bolt passage 228 to allow bolt 70 (not shown in FIG. 14) to pass through and meet with cam 105 (also not shown in FIG. 14). Bolt housing 74 further defines actuator slots 227 and 229 to allow actuators 50 and 52 (not shown in FIG. 14) to pass through and engage bolt 70 (not shown in FIG. 14).

Actuation

Figure 15:
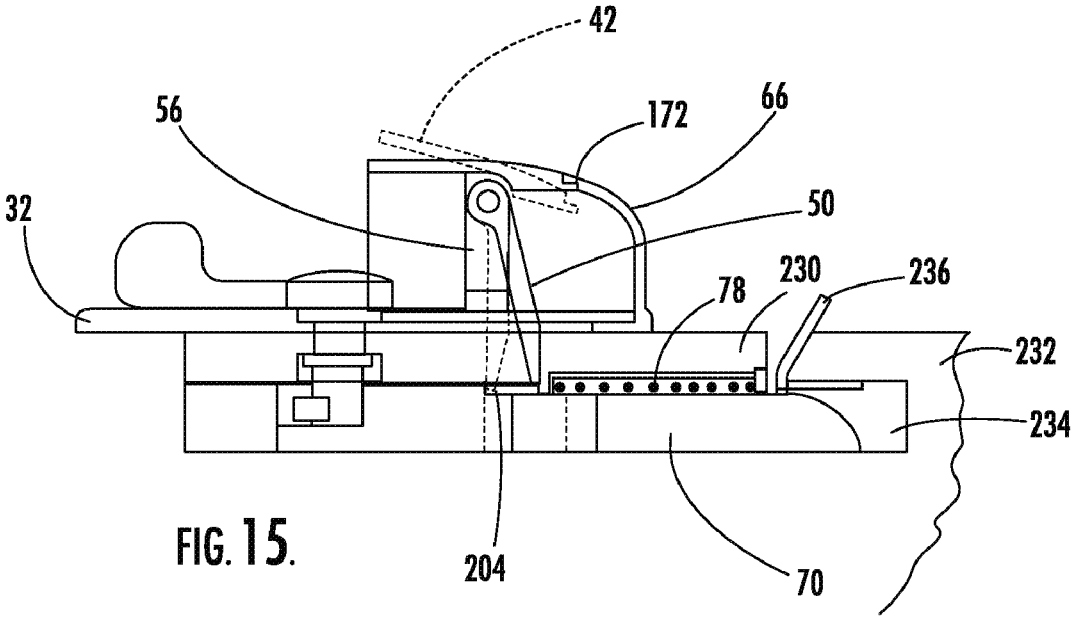
FIG. 15 shows substantially one method of opening a door or disengaging a door from a wall, wherein a handle actuates an actuator and the actuator engages a bolt to slide the bolt away from a wall aperture.

Referring now to FIG. 15, biasing device 78 preferably urge bolt 70 to a first position wherein bolt 70 is configured to protrude from a door 230 and to engage door 230 with a wall 232 by moving into wall aperture 234 surrounded by a striker plate 236. Door handle 42 is attached to actuator 50. Actuator 50 extends through actuator passage (not shown in FIG. 15) of faceplate 32 and through actuator opening 202 to engage bolt 70. Door handle 42 and actuator 50 are attached on actuator mount 56, which serves as a fulcrum allowing handle 42 and actuator 50 to pivot around a pivot axis.

As a user opens door 230, the user holds handle 42 and pulls handle 42 toward him or her. Handle 42 and actuator 50 pivots around the fulcrum provided by actuator mount 56. Actuator 50 moves bolt 70 to a second position wherein bolt 70 moves outside wall aperture 234 thereby disengaging door 230 from wall 232. After the user releases door handle 42, biasing device 78 naturally urges bolt 70 to protrude from door 230 thereby causing door handle 42 to move to a position wherein door handle 42 and faceplate cap 66 defines a substantially flush and substantially flat front surface. Pivot stop 172 of door handle 42 abuts faceplate cap 66 to maintain a substantially flush and substantially flat front surface.

Cam

Figure 16:
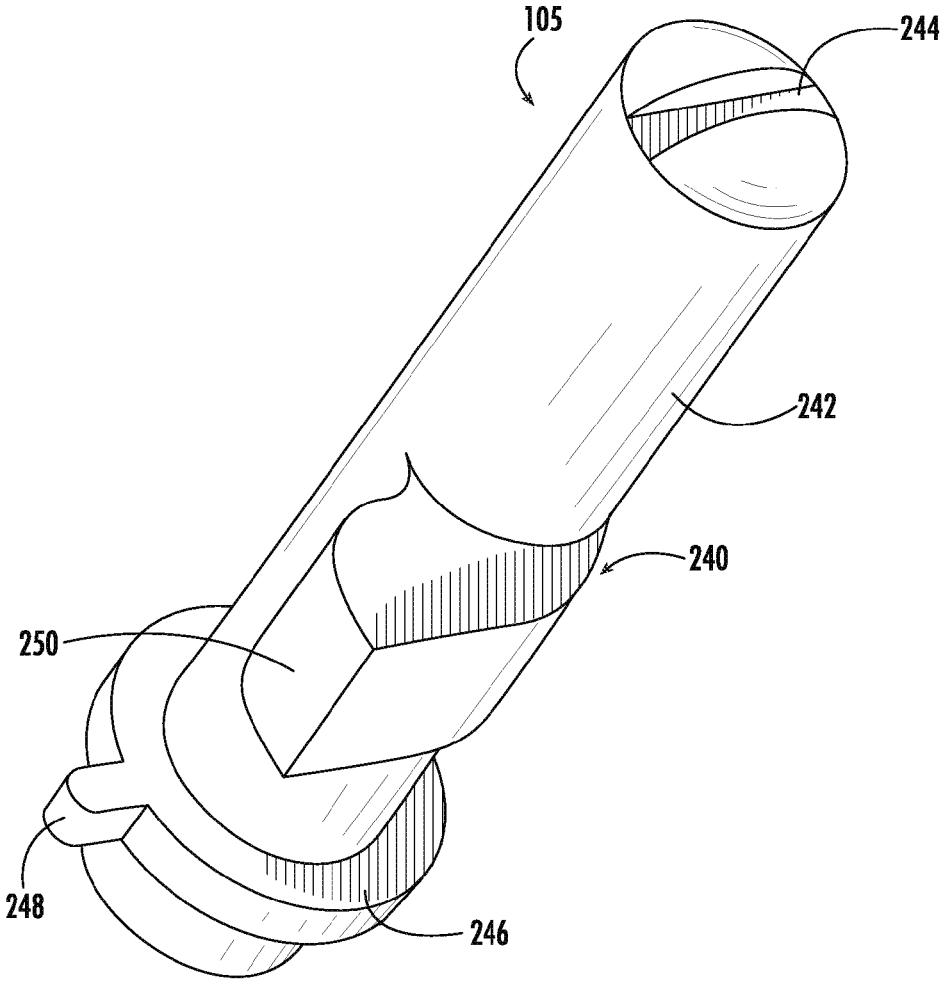
FIG. 16 is substantially a perspective view of an embodiment of a cam of the present invention, the cam being attached to a cam shaft, the cam shaft having a depression to receive a cam actuator, and the cam shaft further having a cam rotation stop to limit the rotation of the cam.

Referring now to FIG. 16, a preferred embodiment of cam 105 has a cam portion 240 attached to a camshaft 242. Cam portion 240 is preferably shaped to fit cam aperture 208 of bolt 70. Cam portion 240 preferably has a raised abutting portion 250 to abut stop surfaces 218 and 220 of bolt 70 (not shown in FIG. 16) and prevent bolt from sliding away from wall aperture thereby locking the door. Cam 105 further has a cam ring 246 and a ring projection 248 transverse from cam ring 246. Ring projection 248 preferably cam stops 148 and 150 (shown in FIG. 8) when cam 105 rotates around its axis of rotation to limit rotation of cam 105.

In the most preferred embodiment, an alternate cam access 244 is positioned at one end of camshaft 242. Alternate cam access 244 is preferably a depression spanning crosswise across the end of camshaft. The depression is preferably sized to fit a flathead screwdriver or a key so that a flathead screwdriver or a key may be used as alternative devices to a cam latch (not shown in FIG. 16) to actuate cam 105.

Locking Mechanism

Figure 17:
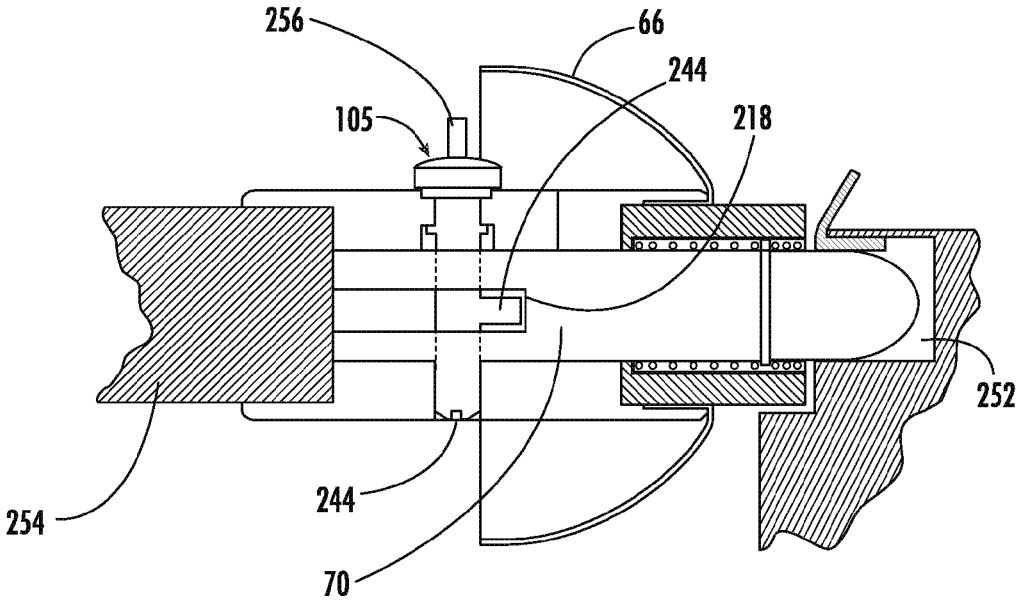
FIG. 17 is substantially an embodiment of a locking mechanism of the present invention, wherein the cam shown in FIG. 16 is in a locked position and the bolt may slide away from the wall aperture to allow the door to open.

Referring now to FIG. 17, a cam latch 256 may be attached to cam 105, which may allow a user to conveniently activate cam 105. By pivoting cam latch 256 within a rotational axis, cam latch 256 moves cam 105 between first and second positions discussed below. Cam latch 256 may be positioned on the side of faceplate 32 where actuator mount 56 (not shown in FIG. 17), faceplate cap 66, and door handle (not shown in FIG. 17) are attached for easy access by the user. Cam 105 may also have alternative cam access 244 to allow a user to use screwdrivers, keys, and the like to access cam from to move cam 105 between first and second positions discussed below.

Cam 105 is preferably positioned perpendicular to bolt 70 and in between fingers 210, 212, 214, and 216 of bolt 70 (not shown in FIG. 17). Cam 105 is configured to be moveable to a first position where raised abutting portion 244 of cam 105 abuts stop surfaces 218 and 220 of bolt 70 (only one stop surface is shown in FIG. 18) thereby preventing bolt 70 from sliding away from a wall aperture 252 and preventing a door 254 from opening.

Figure 18:
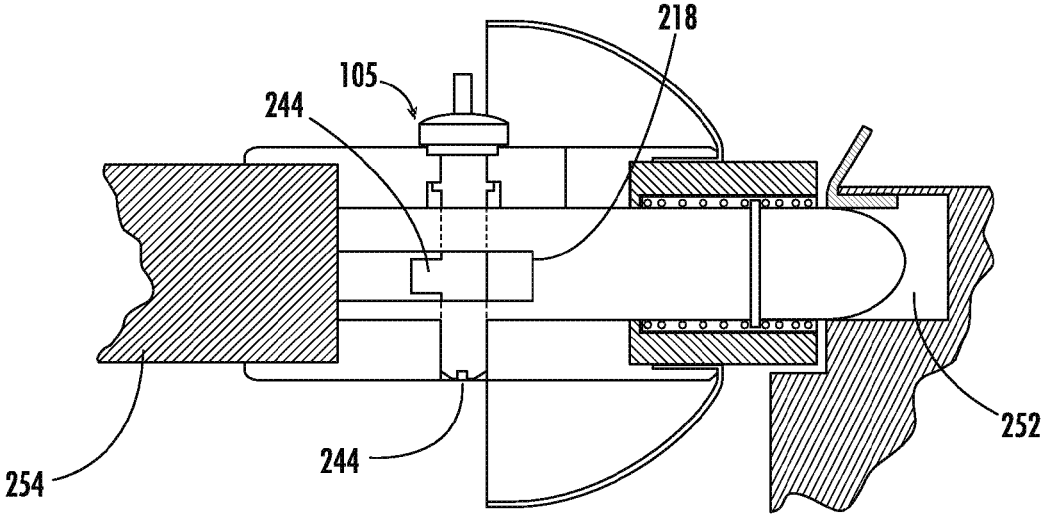
FIG. 18 is substantially the locking mechanism embodiment shown in FIG. 17, wherein the cam is in an unlocked position, and the cam prevents the bolt from sliding away from the wall aperture thereby preventing the door from being opened.

Referring now to FIG. 18, cam 105 may also be movable to a second position wherein raised abutting portion 244 of cam 105 does not abut stop surfaces 218 and 220 of bolt 70 thereby allowing bolt 70 to slide towards a second position wherein bolt 70 is away from wall aperture and thereby allowing door 254 to open.

Closet Door Assembles

Figure 19:
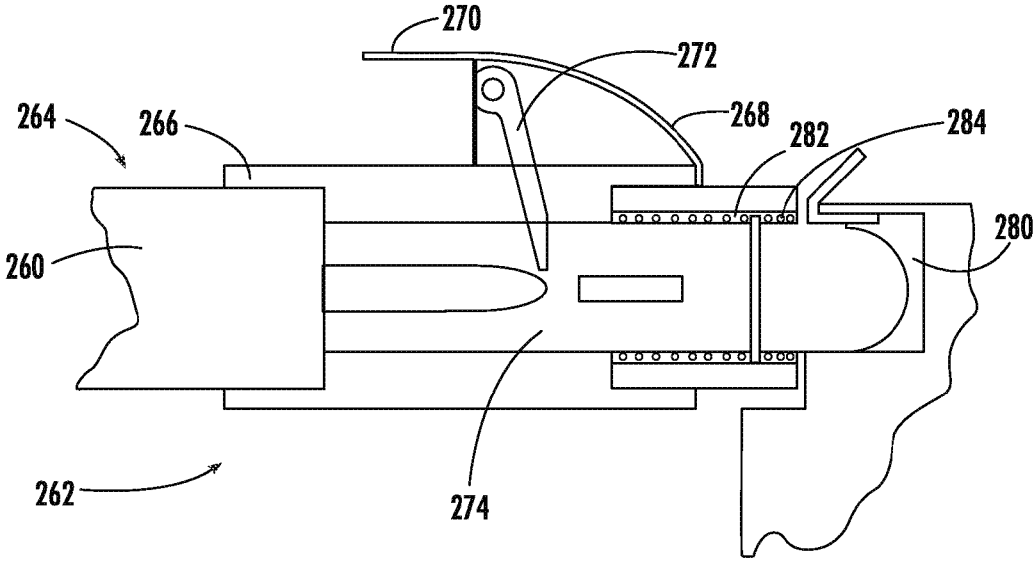
FIG. 19 is substantially an embodiment of the door handle assembly wherein the door may only be opened by using the door handle positioned only on one side of the door.

Referring now to FIG. 19, a door handle assembly of an alternative embodiment is shown. The door handle assembly shown in FIG. 19 may be suited for doors that need not be locked or for doors that only need to be opened from one side. As an example, the door handle assembly may be suited for hall closet doors commonly found in residences. A hall closet door provides access to a relatively small area, which is usually a storage area designated for storing coats and jackets. A hall closet door usually does not lock, and it usually has only one door handle.

Door 260 has a storage side 262, which preferably faces the storage area and a user side 264 opposite the storage area. The door handle assembly has at least a faceplate 266 attached to user side 264. A faceplate cap 268 with an attached handle 270 is preferably attached to faceplate 266. An actuator 272 is attached to handle 270. Actuator 272 and handle 270 are mounted to and may pivot around an actuator mount (not shown in FIG. 19). A portion of actuator 272 is positioned inside an actuator passage (not shown in FIG. 19) of bolt 274.

Biasing devices 282 and 284 urges bolt 274 to move inside a wall aperture 280 thereby closing door 260. To open door 260, actuator 272 may be actuated to move bolt 274 away from wall aperture 280 thereby releasing door 260 from wall aperture 280.

Passage Door Assembles

Figure 20:
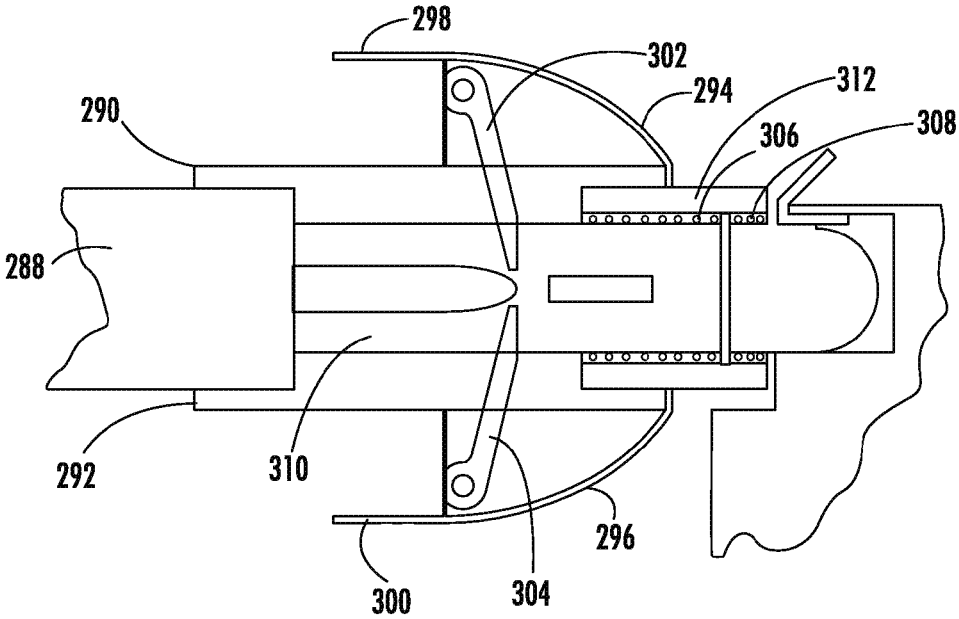
FIG. 20 is substantially another embodiment of the door handle assembly wherein the door may be opened by using the door handles positioned on both sides of the door.

Referring now to FIG. 20, another embodiment of the door handle assembly is shown. The door handle assembly shown in FIG. 20 may be suited for doors that need not be locked and for doors that mainly partition rooms. Additionally, as hall closet doors for people with children, the door handle assembly shown in FIG. 20 may be preferred over the door handle assembly of FIG. 19 because the door handle assembly of FIG. 20 allows the children to open the door from the inside of the closet, and thus eliminates the risk of children being locked inside the hall closet. The door handle assembly shown in FIG. 20 preferably primarily provides passage between rooms, and thus may be opened by using the door handles positioned on both sides of the door.

The door assembly of the embodiment shown in FIG. 20 preferably has opposing faceplates 290 and 292 attached on each side of door 288, faceplate caps 294 and 296 attached to each opposing faceplates 290 and 292, actuator mounts (not shown in FIG. 20) attached to each opposing faceplates 290 and 292, and door handles 298 and 300 with corresponding actuators 302 and 304 connected to actuator mounts. Additionally, the door assembly of the embodiment shown in FIG.

20 preferably has biasing devices 306 and 308, bolt 310, bolt collar 312, and bolt plate (not shown in FIG. 20).

Lockable Door Assembles

Figure 21:
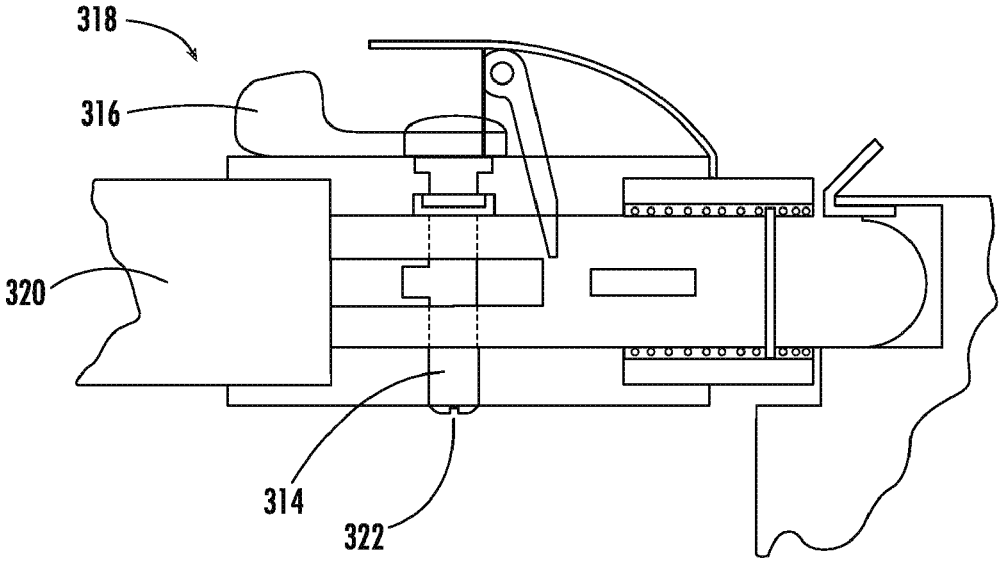
FIG. 21 is substantially another embodiment of the door handle assembly, wherein the door may only be opened by using the door handle positioned only on one side of the door, wherein the door may be locked and unlocked using the cam latch positioned on the same side of the door as the door handle, and wherein the door may be locked and unlocked by actuating cam through an alternate cam access.
Figure 22:
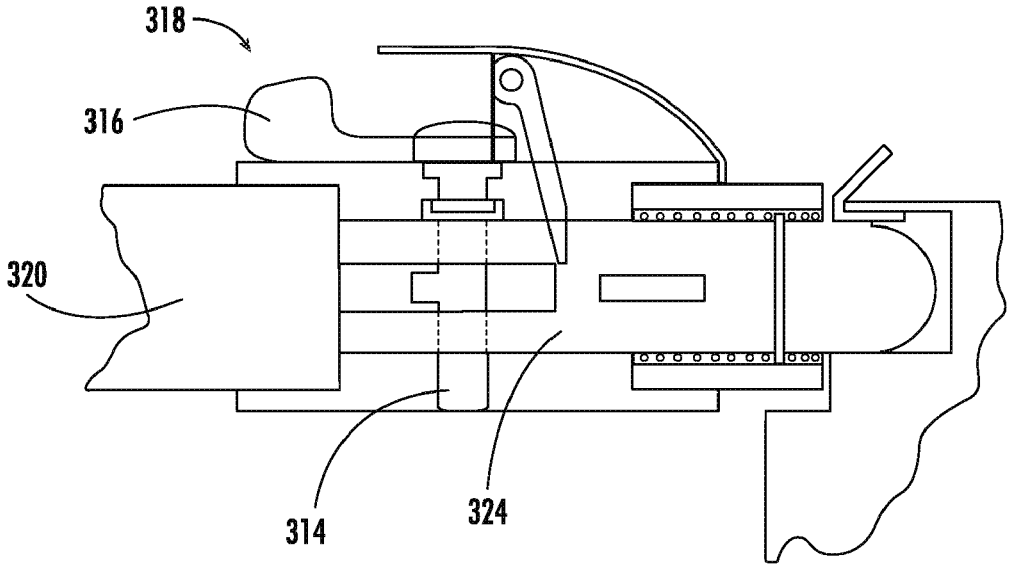
FIG. 22 is substantially another embodiment of the door handle assembly, wherein the door may only be opened by using the door handle positioned only on one side of the door, and wherein the door may be locked and unlocked using the cam latch positioned on the same side of the door as the door handle.
Figure 23:
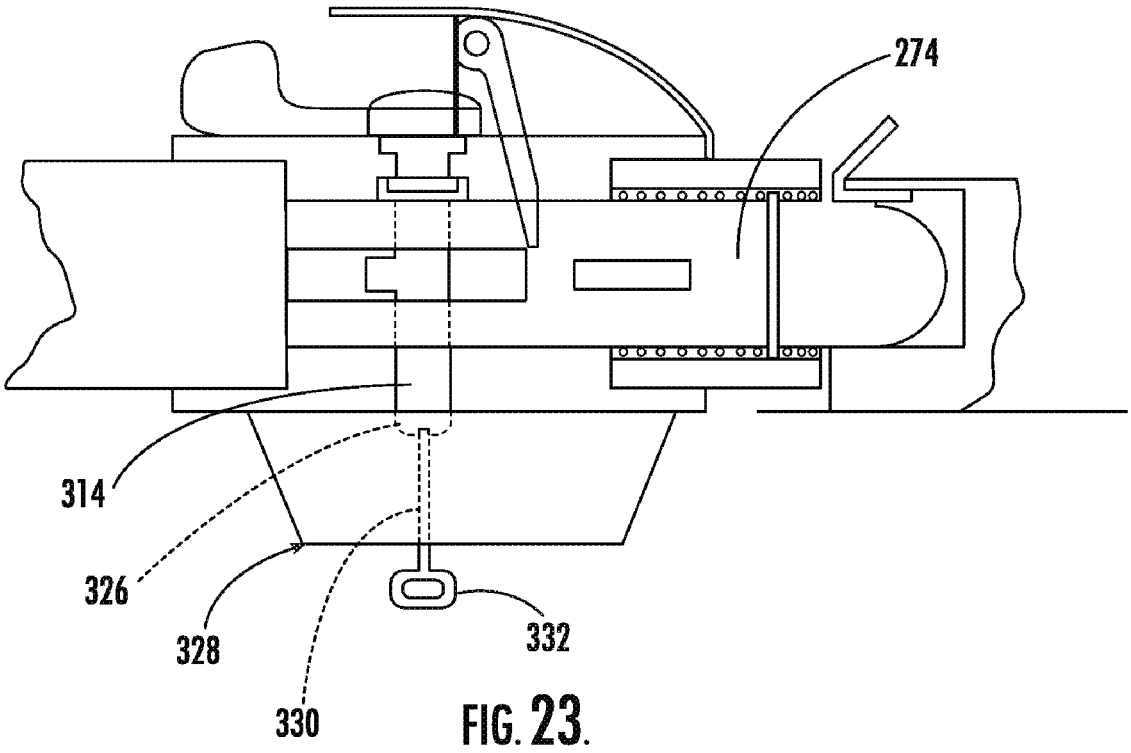
FIG. 23 is substantially another embodiment of the door handle assembly, wherein the door may only be opened by using the door handle positioned only on a first side of the door, wherein the door may be locked and unlocked using the cam latch positioned on the same side of the door as the door handle, and wherein the door may be locked and unlocked by using a key from a second side of the door.

FIGS. 21-23 show additional door handle assembly embodiments. These door handle assembly embodiments may be suited for doors that are desired to be lockable for privacy or security purposes.

Referring now to FIG. 21, the door handle assembly preferably has the same components as the embodiment shown in FIG. 19. Additionally, the door handle assembly of FIG. 21 has a cam 314 described in FIGS. 17 and 18 above. A cam latch 316 may be positioned on one end of cam 314, preferably on the end of cam 314 that is facing a private or secured side 318 of door 320. Side 318 is preferably the side a user desires to prevent or limit access to for privacy or security reasons. Opposite to side 318, cam 314 has an alternate cam access 322 similar to alternate cam access 244 described in FIGS. 17 and 18. Alternate cam access 322 may be used to as an alternate access for unlocking door 320.

Referring now to FIG. 22, the door handle assembly preferably has similar components described in FIG. 21. The door handle assembly embodiment of FIG. 22 preferably does not have an alternate cam access of FIG. 22. Additionally, bolt 324 may have a greater length than the bolt described in FIG. 13.

Referring now to FIG. 23, the door handle assembly preferably has similar components described in FIG. 21. The door handle assembly embodiment of FIG. 23 preferably has an alternate cam access 326 similar to alternate cam access 244 described in FIGS. 17 and 18. An alternate faceplate cap 328 preferably covers alternate cam access 326. Alternate faceplate cap 328 is preferably cylindrical and has a key recess 330 spanning across its vertical axis. A key 332 may be used to actuate cam 314 to lock and unlock bolt 274. Alternate faceplate cap 328 may be made of zinc, brass, or other materials known in the art.

Figure 24:
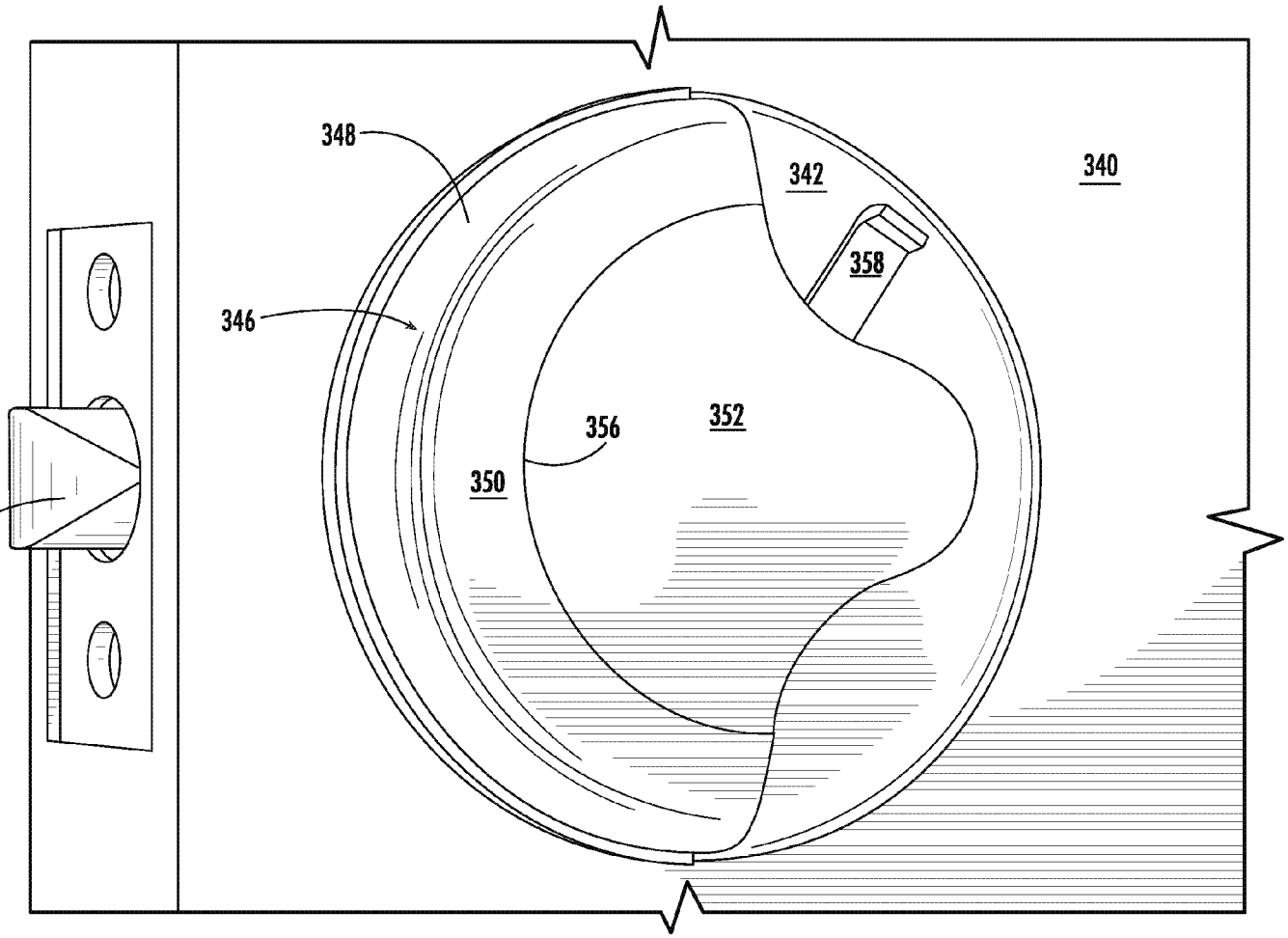
FIG. 24 is substantially perspective view of a door having an embodiment of the door handle assembly attached, the perspective view also showing the low-profile characteristic and non-rotational actuation feature of the door handle.

Referring now to FIG. 24, a preferred embodiment of a door handle assembly has a faceplate 342 attached to a door 340. A faceplate cap 346 is attached to faceplate 342. Faceplate cap 346 has a vertical portion 348 and a horizontal portion 350. Horizontal portion 350 and door handle 352 defines a substantially flat surface 354. Horizontal portion 350 and door handle 352 are further substantially flush, which means horizontal portion 350 and door handle 352 form a substantially continuous plane or substantially unbroken surface except for a boundary 356 between horizontal portion 350 and door handle 352. Door handle assembly may further have a cam latch 358 behind door handle 352.

Door 340 may be opened by pulling handle 352. Handle 352 may be moved around a pivot axis on a horizontal plane. As handle 352 moves around pivot axis, actuator (not shown in FIG. 24) engages bolt 360 and causes bolt 360 to slide within in its sliding axis. Sliding axis of bolt 360 is preferably parallel to the horizontal plane defined by the pivot axis.

Figure 25:
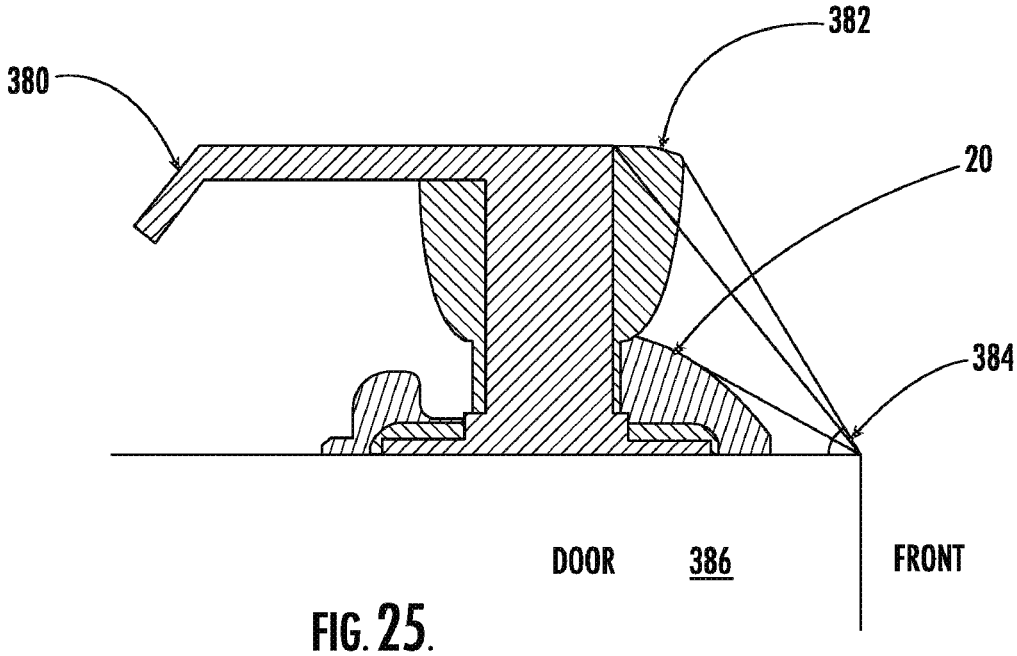
FIG. 25 shows a comparison between the dimensions, including the angles measured from a door surface, of the preferred embodiment of the door handle assembly and the conventional door handle assemblies.

Referring now to FIG. 25, the preferred embodiment of door handle assembly 20 is shown with conventional door handle assemblies 380 and 382. The height of door handle assembly 20 as measured from door 386 is preferably less than the heights of conventional door handle assemblies 380 and 382. Additionally, angle 384 measured from the surface of door 386 to the front surface of door handle assembly 20 is preferably less than those of conventional door handle assemblies 380 and 382.

It can thus be appreciated that certain embodiments of the present invention provide a door handle assembly having a low-profile characteristic. When the door handle assembly of the preferred embodiments shown in FIGS. 24 and 25 is attached to a door and the door is moved toward a wall, the door handle assembly has little or no tendency to contact the wall. Therefore, the door handle assembly of the preferred embodiment minimizes wall damage.

Certain embodiments of the present invention further provide non-rotational actuation feature of the door handle. As shown from the preferred embodiments in FIGS. 24 and 25, the door handle assembly may require a pulling motion. For elderly, physically challenged, persons with wrist problems, and persons carrying objects on both hands, opening a door by a pulling motion may be easier than the conventional rotating motion.

Push Operated Door Handle

Previously described embodiments have described a door handle that is operated by a pulling motion, no matter which direction the door swings when opened. However, it may be beneficial to provide door handle assemblies where the motion used to actuate the door handle also serves to open the door. For example, a pulling motion may be most useful to operate a door handle when a door will swing inward, towards a person opening the door. A pushing motion may be used to operate a door handle when a door is to swing outward, away from a person opening a door. In this way, opening the door requires less force and operates in a more fluid manner. Such an embodiment may be especially useful for the disabled or for those who are not able to apply large amounts of force to operate a door handle and open a door.

With reference to FIGS. 26-34, a push operated door handle apparatus 400 is shown. Some of the components used in apparatus 400 are the same as previously described in the description of pull operated door handle apparatus 20.

Door handle apparatus 400 can include a bolt plate 80, a frame plate 502, a bolt 476, a bolt collar 72 and a coil spring 78. Bolt 476 has a bolt aperture 474 and is adapted to fit into a bolt collar 72 which is mounted in a door. Coil spring 78 biases bolt 476 away from bolt collar 72. Bolt 476 can have a pair of bolt sleeves 520 arranged between bolt collar 72 and bolt 476. Bolt sleeves 520 allow bolt 476 to slide more easily within bolt collar 72. A support block 525 is adapted to fit into bolt aperture 476. Support block 525 reduces wear during actuation of the bolt.

Door handle apparatus 400 may comprise a handle 404 that has ends 404A and 404B. Door handle 404 has projections 410 and 560 that are located toward end 404B. Projection 410 has an aperture 411. Projections 560 have holes 562.

Faceplates 448 and 449 each have a mount 416 that extends away from the faceplate. Faceplates 448 and 449 are mounted on opposite sides of a door (not shown). Mount 416 has parallel projections 418 that extend away from the faceplate. Each parallel projection 418 has a pin opening 422. Projection 410 is adapted to be secured to mount 416.

Mount 416 is shown as a yoke or fork; however other mounts may be used. In certain embodiments, projection 410 can extend into and between parallel projections 418 (only one of which is visible in FIG. 26) of mount 416 and may secured to mount 416 by any suitable means, such as by inserting a pin 419 through hole 411 and pin openings 422 in parallel projections 418. In this manner handle 404 is rotatably connected to faceplate 449.

Similarly, a pull handle 406 can be rotatably mounted to faceplate 448 by pin 438. Pull handle 406 has ends 406A and 406B. An actuator 550 extends away from pull handle 406 toward end 406B. Actuator 550 has an end 551 and a hole 552.

Mount 416 of faceplate 448 also has parallel projections 418. Pin 438 passes through hole 552 and pin openings 422 in parallel projections 418. In this manner handle 406 is rotatably connected to faceplate 448. Pin 438 also supports wire spring 540. Spring 540 biases handle 406 away from faceplate 448.

An actuator 430 may also be attached to mount 416. Actuator 430 has a hole 431 and a projection 470. Actuator 430 may be coupled to mount 416 by any suitable means, such as by inserting a pin 436 or other suitable fastener into pin openings 440 and 442 in parallel projections 418 and hole 431 in actuator 430, respectively. Mount 416 may be integrally formed on a faceplate 449 or may be coupled to faceplate 449 by any suitable means, such as by welding or adhesives. Pin 436 also supports wire spring 542. Spring 542 biases handle 404 away from faceplate 449.

Projections 560 of door handle 404 may also have a roller or linkage 454 coupled thereto. Roller 454 may be a ball bearing, a bicycle chain roller, a metal roller, or a roller constructed of other materials, including rubbers, plastics, and the like. In certain embodiments, such as the one depicted in FIG. 26, roller 454 may rotate about a vertical axis. Roller 454 may rest against a curved surface 460 of actuator 430. Roller 454 may be attached to, and rotate around, a pin 462 of handle 404. Pin 462 passes through holes 562 and roller 454. Roller 454 may be attached to door handle 404 in other ways without departing from the scope of the present invention.

Figure 28:
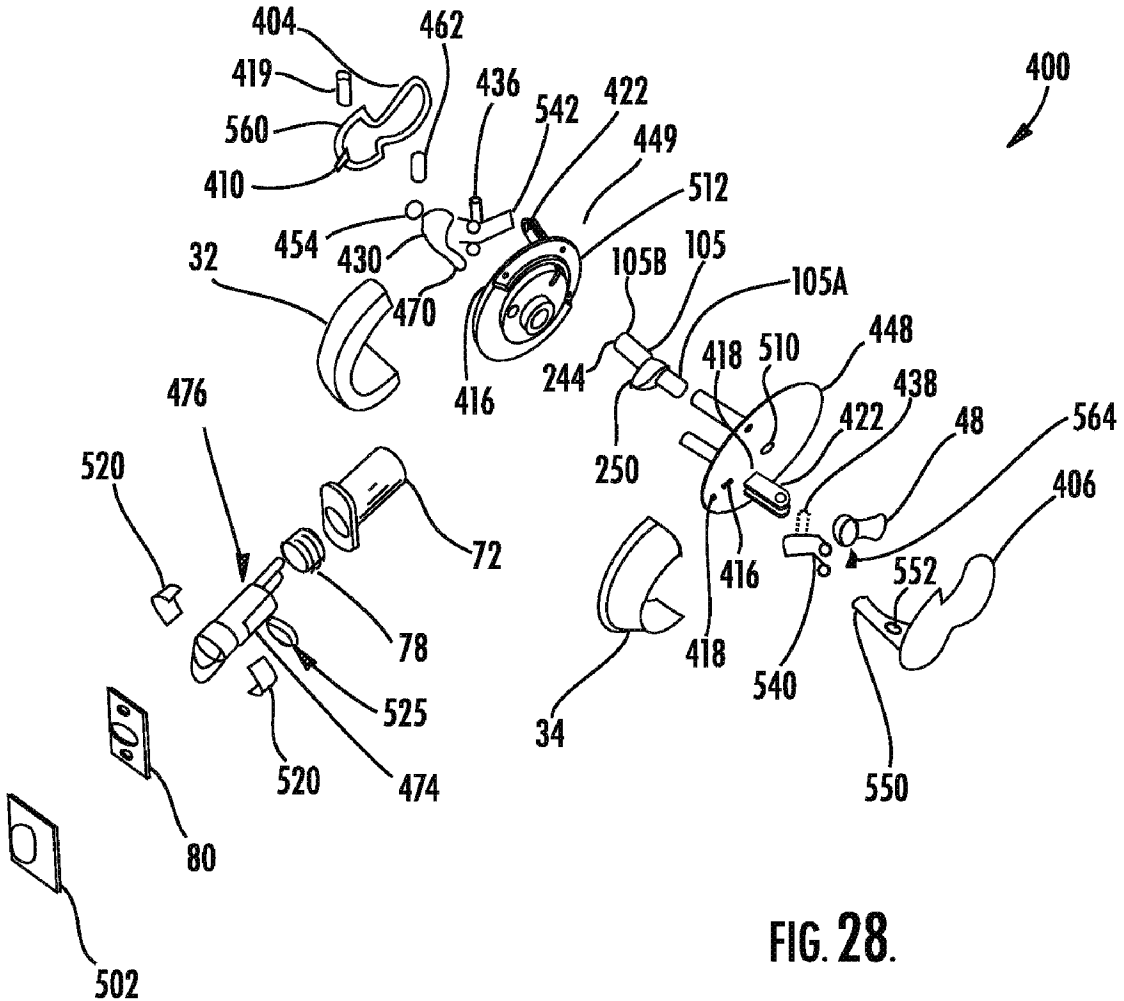
FIG. 28 is substantially an exploded view of the push operated door handle assembly of FIG. 26.
Figure 29:
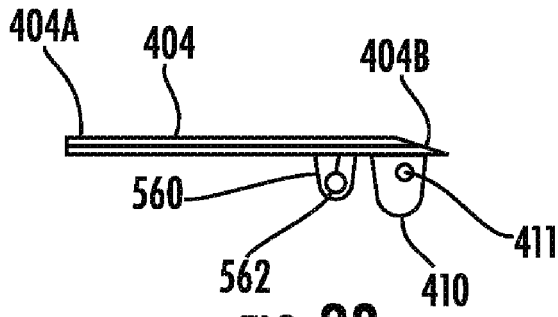
FIG. 29 is substantially a top view of the push door handle of FIG. 28.
Figure 30:
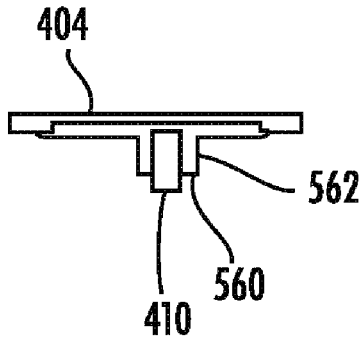
FIG. 30 is substantially a side view of the push door handle of FIG. 28.
Figure 31:
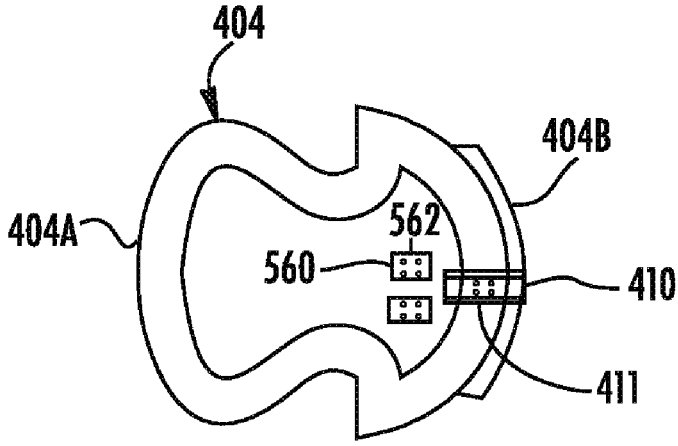
FIG. 31 is substantially a rear view of the push door handle of FIG. 28.
Figure 32:
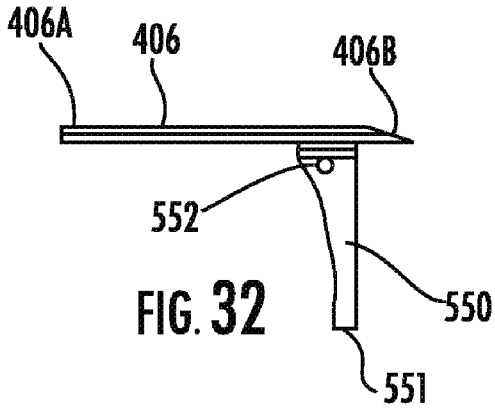
FIG. 32 is substantially a top view of the pull door handle of FIG. 28.
Figure 33:
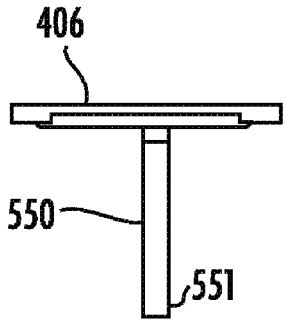
FIG. 33 is substantially a side view of the pull door handle of FIG. 28.
Figure 34:
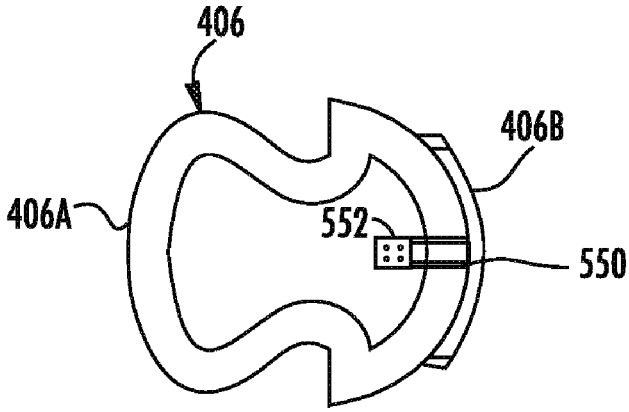
FIG. 34 is substantially a rear view of the pull door handle of FIG. 28.

Referring now to FIG. 28, door handle assembly 400 may further include a cam assembly 105. Cam assembly 105 is rotatably supported and mounted between faceplates 448 and 449. Faceplate 448 has a hole 510 and faceplate 449 has a hole 512. Cam assembly 105 has an end 105A, an end 105B and a raised abutting portion 250. End 105A extends through hole 510 and end 105B extends through hole 512. Further details of cam assembly 105 are shown in FIG. 16. Can assembly 105 includes a cam portion 240 and a cam shaft 242. Turning back to FIG. 28, cam assembly 105 is shaped to fit with bolt 476 so as to lock the door. Raised abutting portion 250 is adapted to abut bolt 476 and prevent the bolt from sliding away from the frame plate 502 thereby locking the door.

A cam latch 48 can be secured to end 105A through the use of set screw 564. When cam latch 48 is rotated in one direction, raised abuting portion 250 prevents movement of bolt 476. Cam assembly 105 can further operate as previously described. An alternate cam access 244 can be mounted to end 105B. Alternate cam access 244 can be a depression that allows a flathead screwdriver or key to rotate cam assembly 105.

Figure 26:
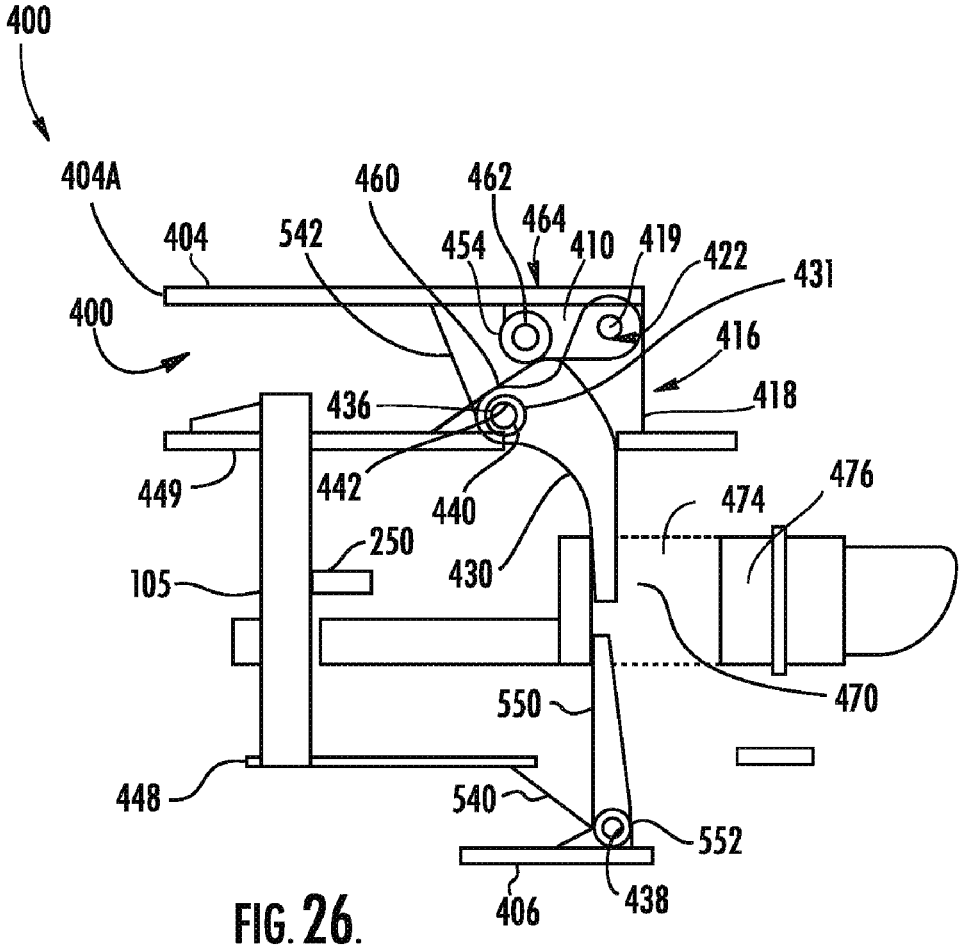
FIG. 26 is substantially a top partial cutaway view of an alternative, push operated door handle assembly according to the present invention.
Figure 27:
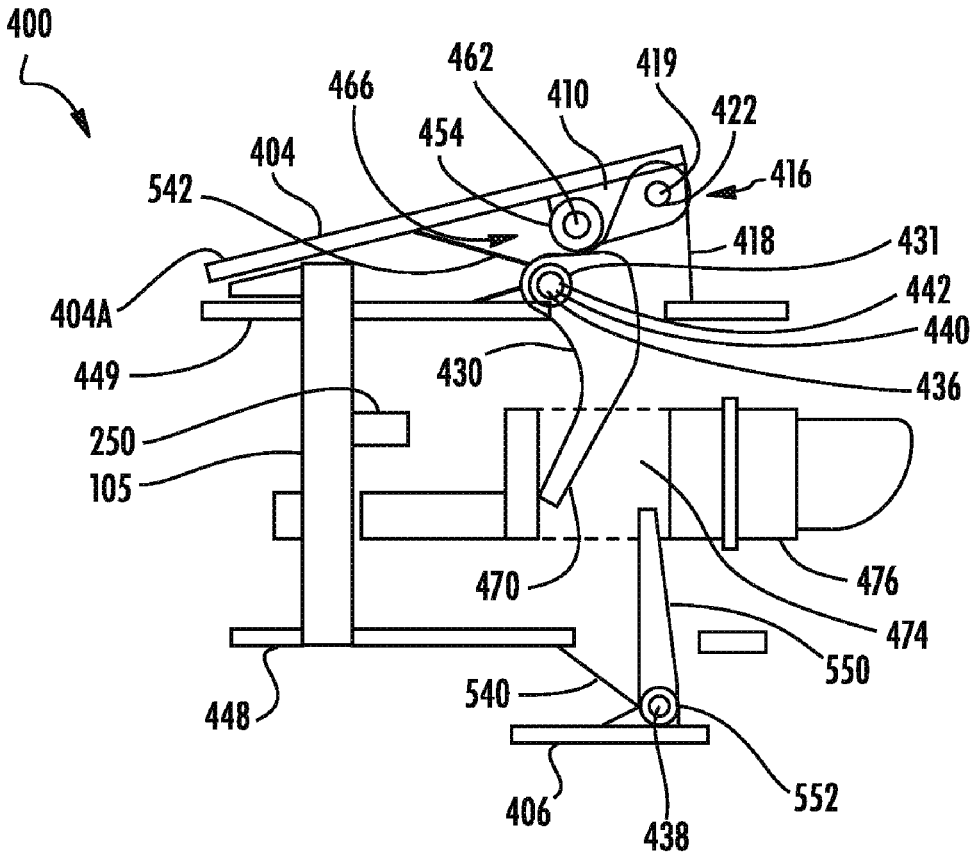
FIG. 27 is substantially a top partial cutaway view of the push operated door handle assembly of FIG. 26 wherein the door handle has been pushed.

With reference now to FIGS. 26 and 27. When the door handle assembly 400 is not being actuated, roller 454 may rest at a first position 464 on actuator 430. When handle 404 is pushed, roller 454 will travel along surface 460 of actuator 430, eventually reaching a second position 466, shown in FIG. 27. Referring back to FIG. 26, during operation, force will be transmitted from handle 404, through roller 454, to actuator 430. As roller 454 moves, the transmitted force will cause force to be applied to actuator 430 in different directions, causing actuator 430 to move. At the same time handle 404 will pivot about pin 419 with handle end 404A moving toward faceplate 449. A projection 470 of actuator 430 passes into actuator opening 474 formed in a bolt 476. As roller 454 moves from first position 464 to second position 466, projection 470 of actuator 430 will engage a portion of the interior of bolt 476 towards the interior of a door (not shown in FIG. 26), causing bolt 470 to be retracted away from a wall aperture in a wall (not shown in FIG. 26).

Bolt 470 may be biased towards the frame plate by spring 78. When force is no longer applied to door handle 404, springs 78 and 542 will cause bolt 470 to be biased towards the frame plate 502, in turn causing roller 454 to move from second position 466 back to first position 464 and handle 404 to move away from faceplate 449 back to an un-depressed position.

Figure 35:
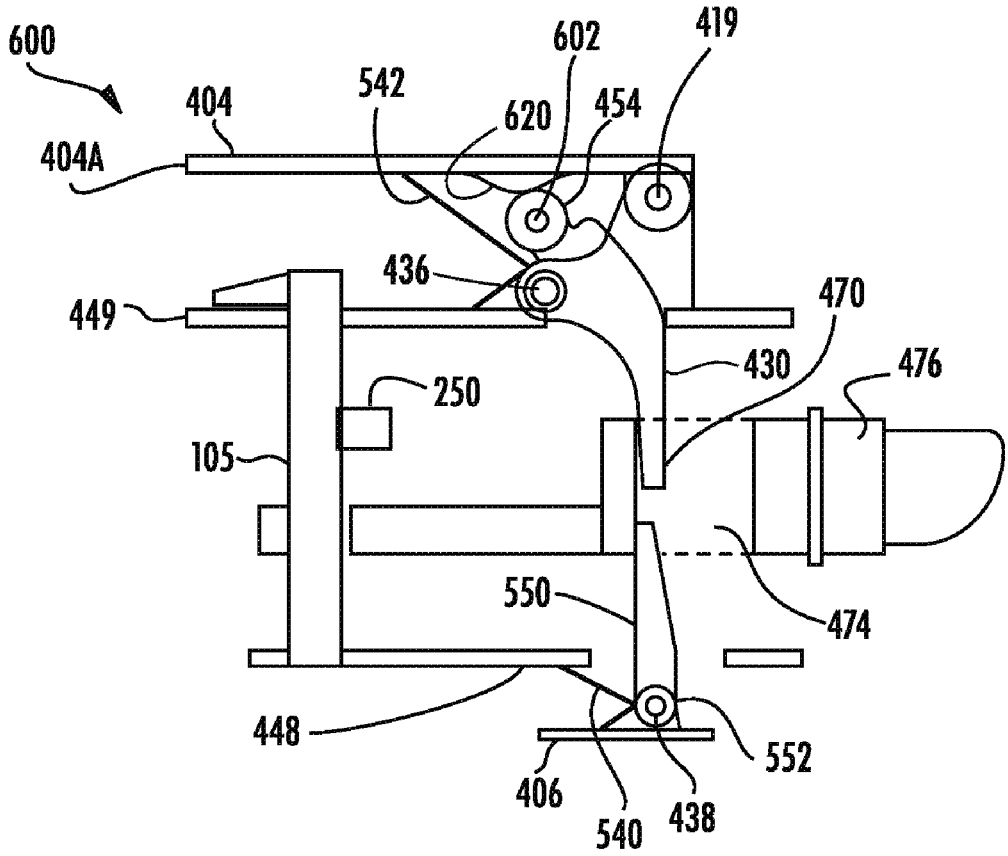
FIG. 35 is substantially a top partial cutaway view of another embodiment of a push operated door the door handle assembly wherein the door handle is generally at rest.
Figure 36:
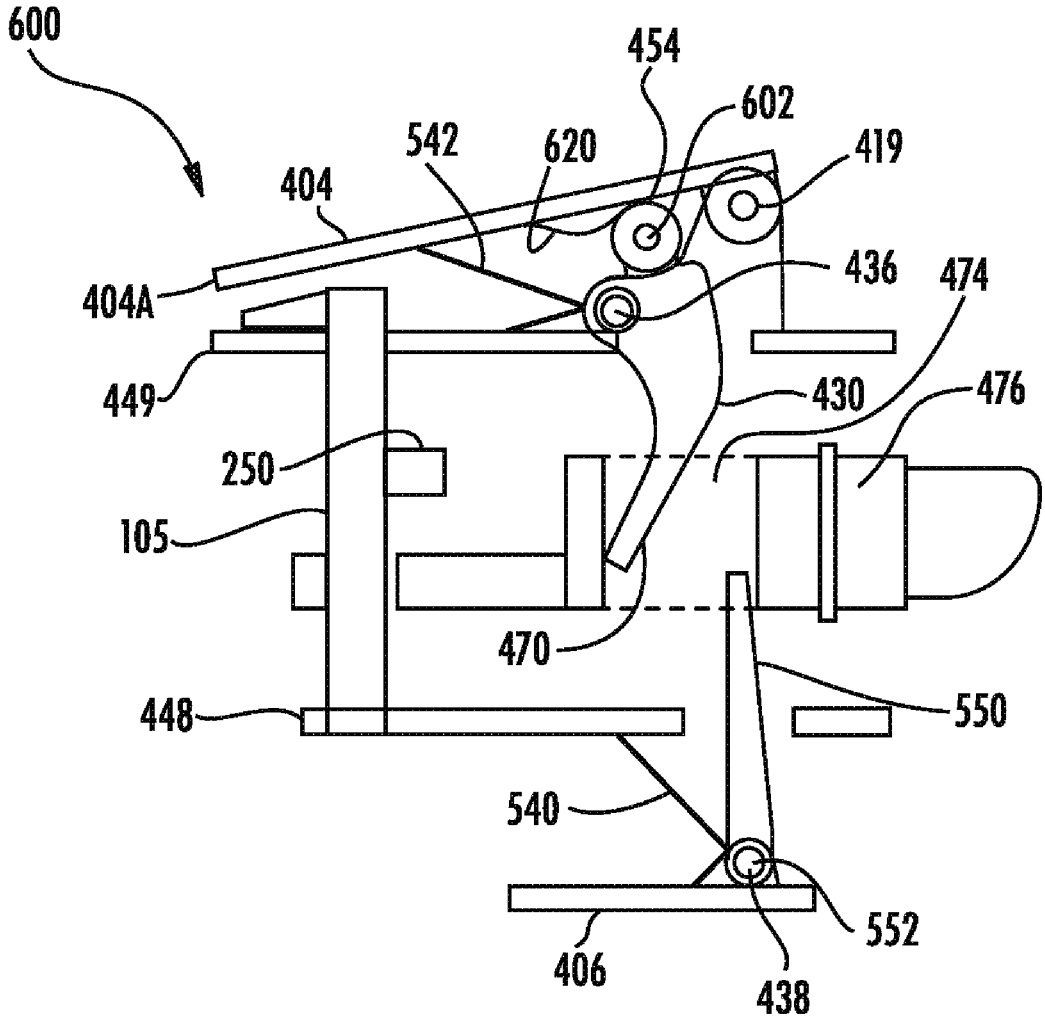
FIG. 36 is substantially a top partial cutaway view of the push door handle assembly of FIG. 35 wherein the door handle is generally depressed.

The present invention is not limited by the position of roller 454 or curved surface 460. For example, as shown in FIGS. 35 and 36 another embodiment of a push door handle assembly 600 is shown. Push door handle assembly 600 can have a roller 454 that is mounted on actuator 430 using pin 602. Curved surface 620 may be on door handle 404. Operation of this embodiment is analogous to that of the door handle assembly 400 previously described in FIGS. 26 and 27.

With reference now to FIGS. 26 and 27, the door can also be opened by the use of pull handle 406. Pull handle 406 can operate the same as previously described for door handle assembly 20. Pull handle 406 is rotatably mounted to faceplate 448 by pin 438. Actuator 550 has an end 551 that extends into bolt aperture 476. Pulling on handle 406 causes bolt 476 to retract allowing opening of the door.

The components of door handle assembly 400 may be used with any previously described door handle assemblies, or with other door handle assemblies now existing or later developed, that are within the knowledge of one skilled in the art. In certain embodiments, a door handle assembly may be configured so that it has push handles on both sides of the door handle assembly.

Door Handle Assembly with Lock Release Mechanism

FIGS. 37-46 show an additional door handle assembly embodiment with a lock release mechanism. In some building types, building codes may require that a locked door become unlocked when a user actuates the door handle. The door handle on the outside of the room or building would not deactivate the lock and open the locked door. Only the handle on the inside of the room or building would deactivate the lock and unlock the door when the handle is pushed or pulled. Further, such an embodiment may be beneficial for the disabled or elderly who lack dexterity or strength.

The door handle assembly embodiment of FIGS. 21-23 requires that the cam latch be moved in order to unlock the door. In an emergency, a user may not be able to see the cam latch or be able to operate the cam latch.

Figure 37:
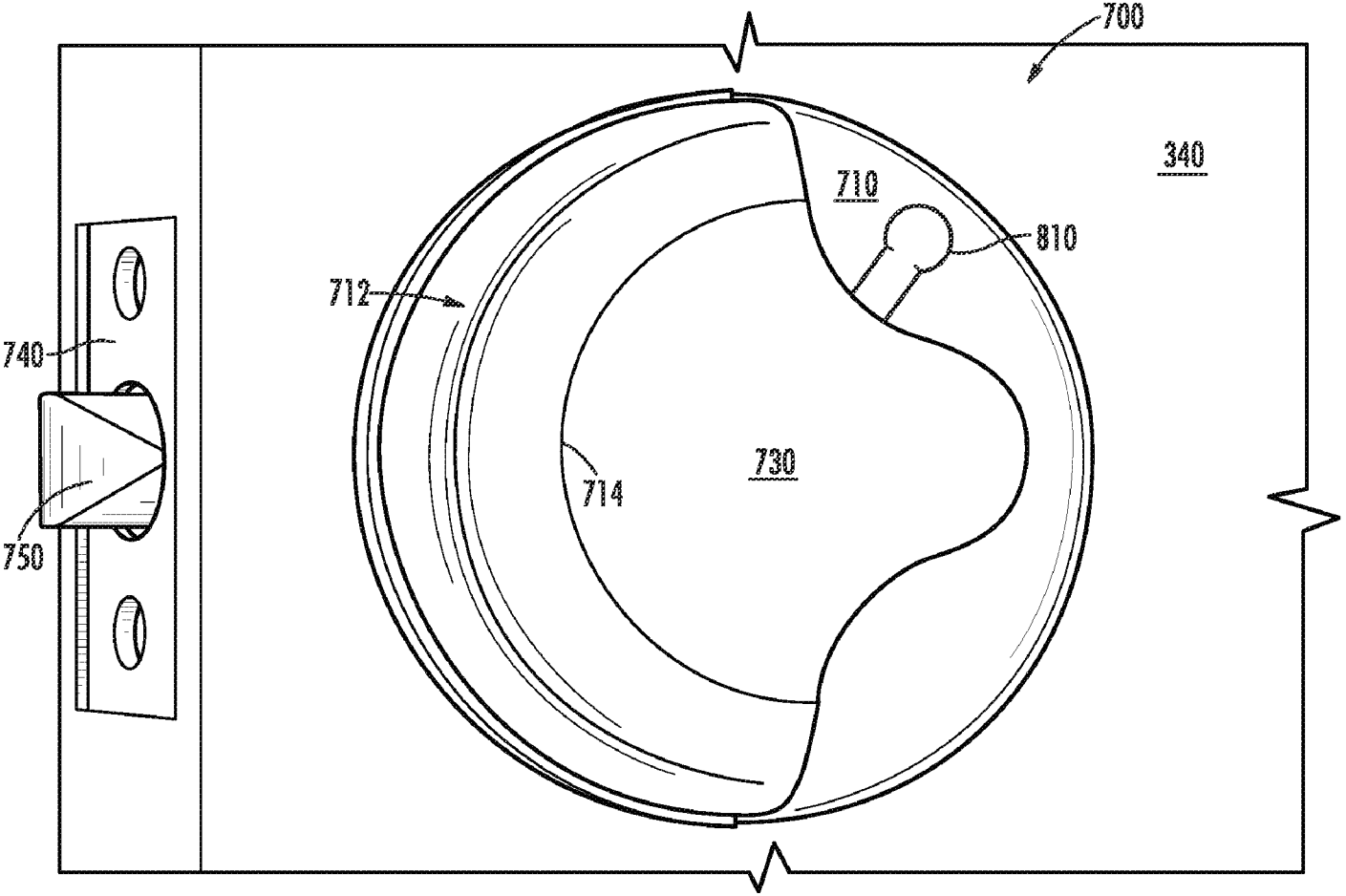
FIG. 37 is substantially perspective view a perspective view of another embodiment of the present invention depicting a door handle assembly with a lock release mechanism.
Figure 38:
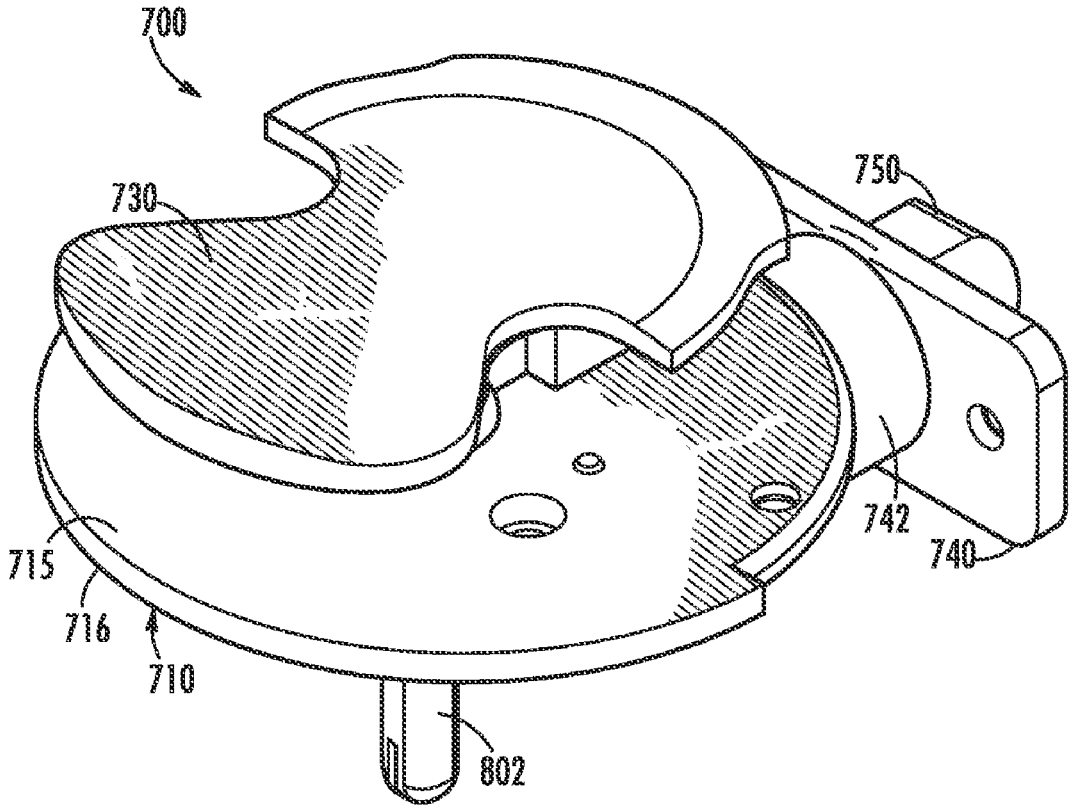
FIG. 38 is substantially an exterior perspective view of the door handle assembly with a lock release mechanism.

Referring now to FIG. 37, door handle assembly 700 can have a mount or faceplate 710 attached to a door 340. A faceplate cap 712 is attached to faceplate 710. Door handle 730 is mounted to faceplate 710. Faceplate cap 712 and door handle 730 meet at a boundary 714 and defines a substantially flat surface. Door handle assembly 700 may further have a cam latch 810 located behind door handle 730. Door bolt 750 is retained by a bolt plate 740 that is mounted to door 340. Bolt 750 would slide into and away from a wall aperture (FIG. 17) as was previously described.

Door 340 may be opened by pulling handle 730. Handle 730 may be moved around a pivot axis on a horizontal plane. As handle 730 moves around the pivot axis, a portion of the handle (not shown in FIG. 37) engages bolt 750 and causes bolt 750 to slide within on a sliding axis. The sliding axis of bolt 360 is preferably parallel to the horizontal plane defined by the pivot axis.

With reference to FIGS. 38-41, faceplate 710 can further include an outer surface 715, an inner surface 716, a raised area 717, an aperture 718, an aperture 719, an opening 720 and posts 721 and 722. A portion of inner surface 716 would rest on door 340. Apertures 718 and 719 are used with fasteners (not shown) such as screws to attach faceplate 710 to door 340. Faceplate 710 also has a stop 723 that extends from raised portion 717.

Figure 42:
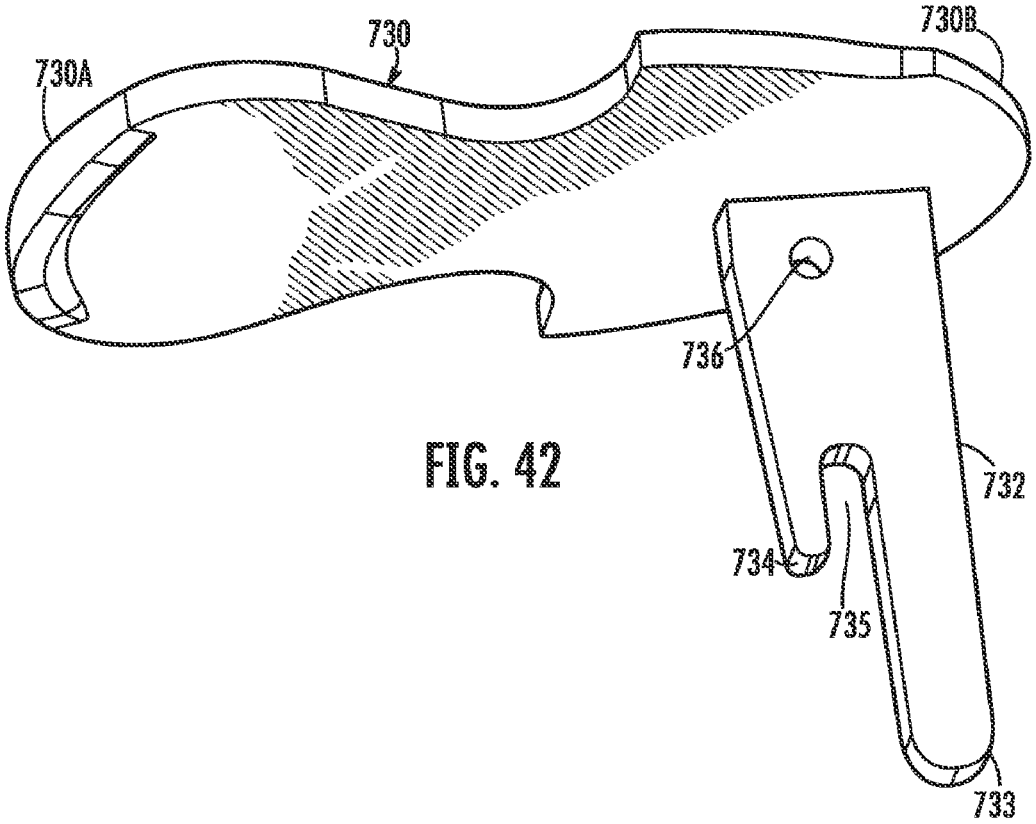
FIG. 42 is substantially a perspective view of the pull door handle of FIG. 39.

Handle mount 724 may include two parallel projections, an upper projection 725 and a lower projection 726. Holes 727 pass through projections 725 and 726. Fastener pin 728 extends through holes 727 and through handle hole 736 (FIG. 42). Fastener pin 728 allows handle 730 to pivot about fastener pin 728. Pin 728 can be slight larger at both ends such that the ends of pin 728 are press fit into holes 727. At the same time, the middle of pin 728 is slightly smaller allowing handle 730 to rotate about pin 730.

Turning now to FIG. 42, handle 730 can have ends 730A, 730B and an actuator 732 having an actuator tip 733. Projection 734 extends from actuator 732. A recess 735 is located between actuator 732 and projection 734. Handle hole 736 is located in actuator 732.

Figure 39A:
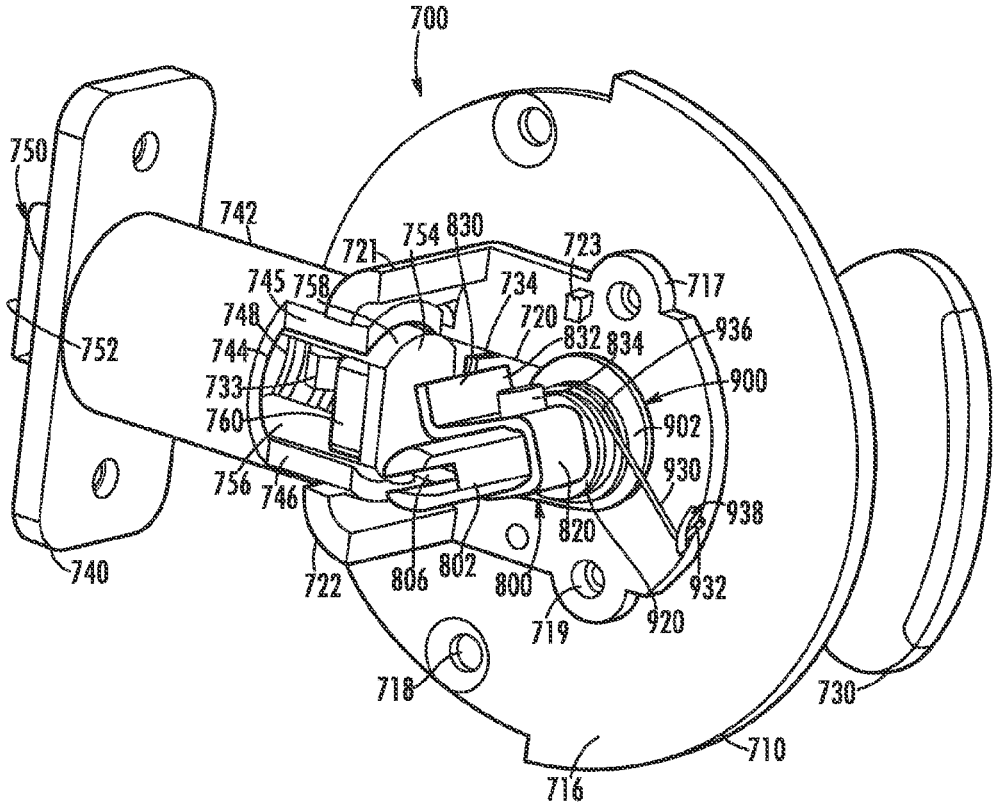
FIG. 39A is substantially an interior perspective view of the door handle assembly with a lock release mechanism.
Figure 39B:
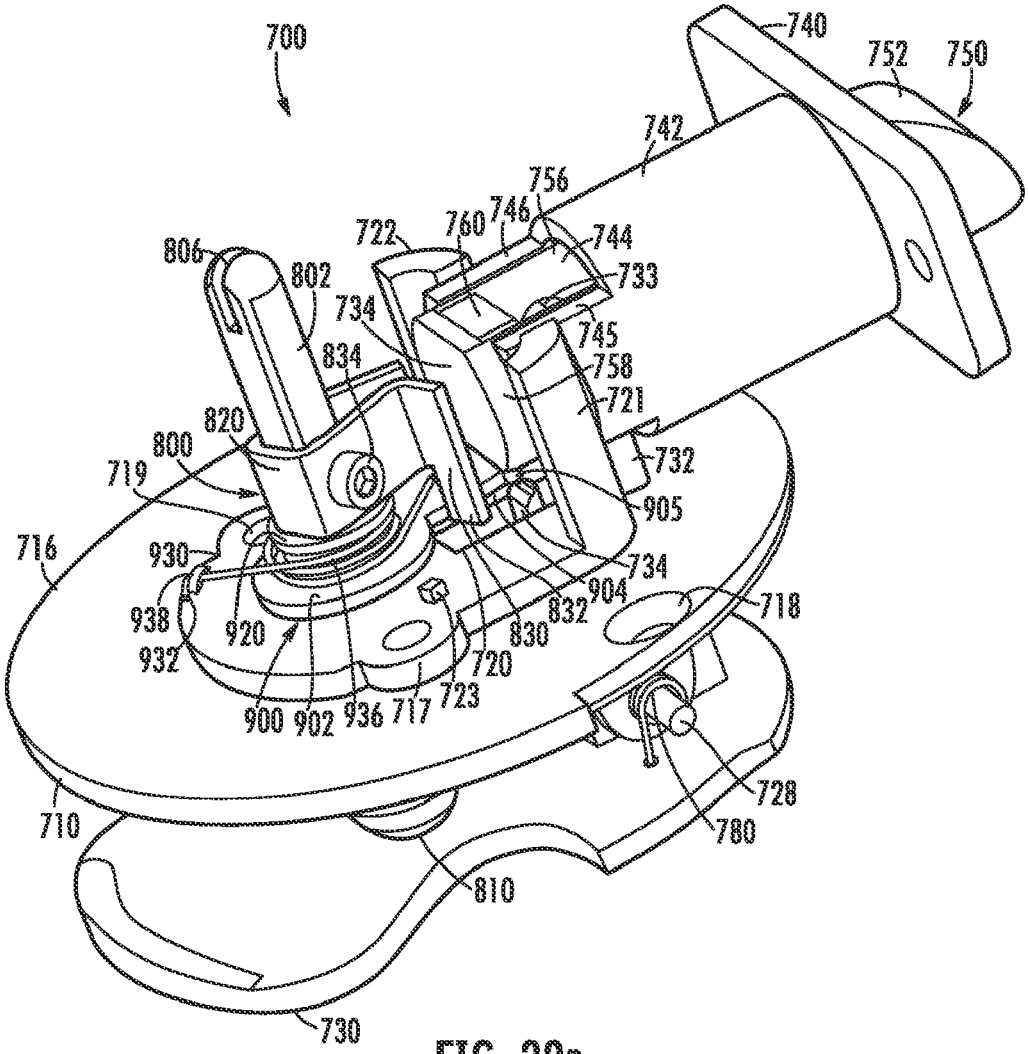
FIG. 39B is substantially another interior perspective view of the door handle assembly with a lock release mechanism.
Figure 40A:
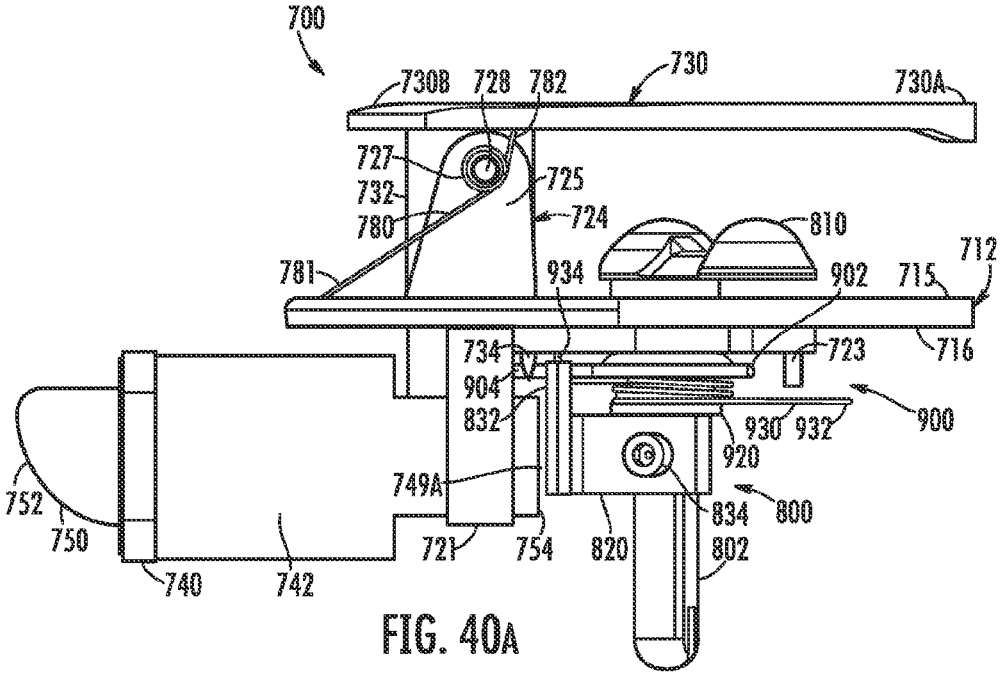
FIG. 40A is substantially a top view of FIG. 39 with the door handle assembly in a locked position.
Figure 40B:
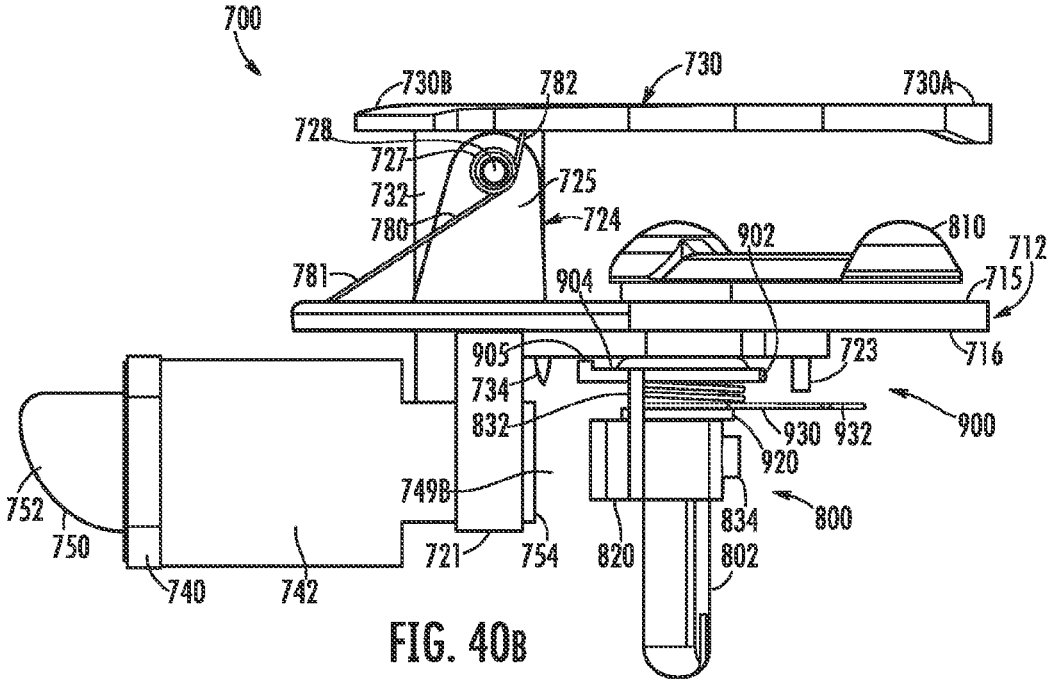
FIG. 40B is substantially a top view of FIG. 39 with the door handle assembly in an unlocked position.
Figure 41:
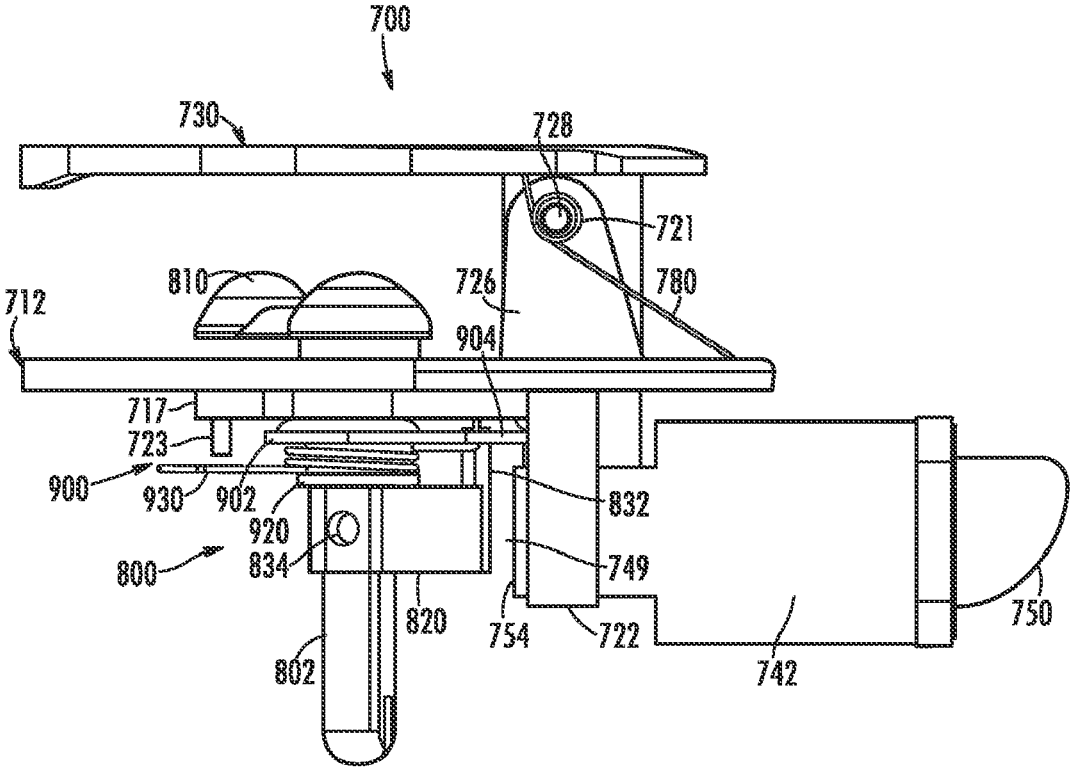
FIG. 41 is substantially a bottom view of FIG. 39.

With reference to FIGS. 39, 40A and 40B, bolt plate 740 is connected to bolt collar 742. Bolt collar 742 extends into door 340 (FIG. 37). Bolt collar 742 has a bore 744 and a pair of arms 745 and 746 that extend from one end of bolt collar 742. Bolt spring 748 is mounted inside bore 744 and biases bolt 750 outwardly.

Bolt 750 includes a tapered end 752 that can mate with a door aperture (not shown) and a flat end 754. End 754 extends through bore 744 between arms 745 and 746. Bolt 750 further includes an opening 756 and an outer surface 758. Outer surface 758 slides within bore 744. A block 760 is mounted in opening 756 adjacent flat end 754.

A U-shaped door handle spring 780 can be mounted around fastener pin 728. Door handle spring 780 is a torsion spring with ends 781 and 782. End 781 rests on outer surface 715 of faceplate 710 and end 782 is engaged with door handle 730. Door handle spring 780 biases door handle end 730A toward faceplate 715. In other words, when door handle 730 is released after being pulled, door handle spring 780 causes door handle 730 to move to the normal position shown in FIGS. 40A and 40B.

Cam assembly 800 can include a camshaft 802 and a cam latch 810 and a locking cam 820 that are mounted to camshaft 802. With specific reference to FIG. 44, camshaft 802 has an end 803 and an end 804. Hole 805 extends through camshaft 802. End 803 has a slot 806. Flat portions 808 may be located on four sides of camshaft 802 and assist with retaining locking cam 820. A cam latch 810 is mounted to end 804. A bore 812 may be located in cam latch 810 and may mate with end 804 by press fitting or may be held with a set-screw or any other suitable fastening means.

Figure 44:
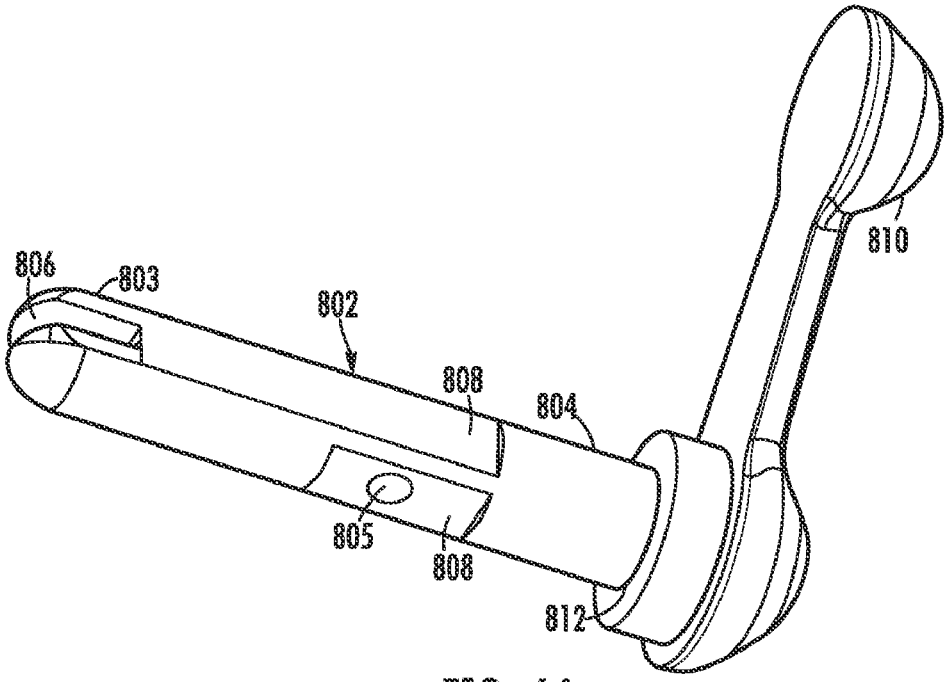
FIG. 44 is substantially a perspective view of a cam shaft and cam latch.
Figure 45:
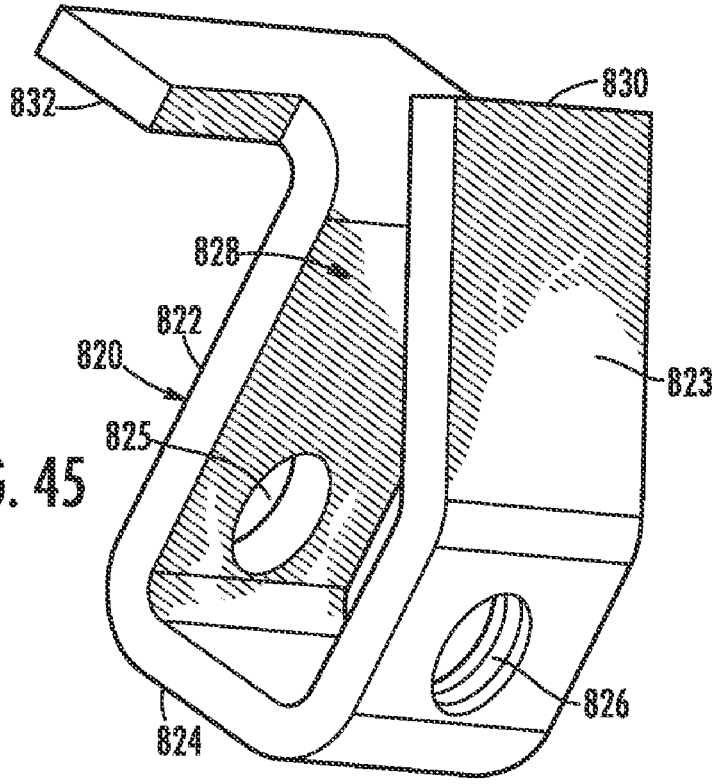
FIG. 45 is substantially a perspective view of a locking cam.

Turning now to FIG. 45, an enlarged view of locking cam 820 is shown. Locking cam 820 is mounted to camshaft 802 (FIG. 44). Locking cam 820 can include arms 822 and 823 that are connected by a center section 824. A hole 825 is located in arm 822. A threaded hole 826 is located in arm 823. Recess 828 extends between arms 822 and 823. Arm 823 has an end 830. Arm 822 may have a post 832 that extends from arm 822. Screw 834 (FIG. 40A, 40B) can be used to hold locking cam 820 to camshaft 802. Screw 834 extends through hole 825, hole 805 of camshaft 802 and into threaded hole 826. Locking cam 820 can abut bolt end 754 and cause bolt 750 to be locked in place.

With reference now to FIGS. 39A, 39B, 40A and 40B, a lock release mechanism 900 can be mounted adjacent inner side 716. Lock release mechanism 900 can include a release cam 902, a rotating cylinder 920 and spring 930. Lock release mechanism 900 can cause locking cam 820 to move from a locked position to an unlocked position.

Figure 43:
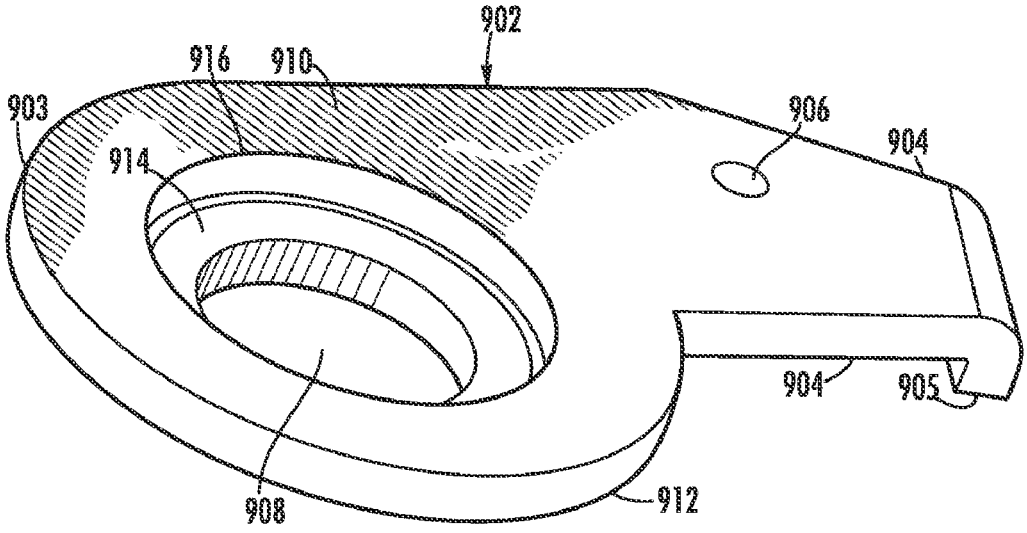
FIG. 43 is substantially a perspective view of a release cam.

As shown in FIG. 43, release cam 902 can have a rounded end 903 and an arm 904. A lip 905 is located on the end of arm 904. Release cam 902 further includes a hole 906, aperture 908, surfaces 910 and 912 and an annular step 914 that is defined by bore 916.

Figure 46:
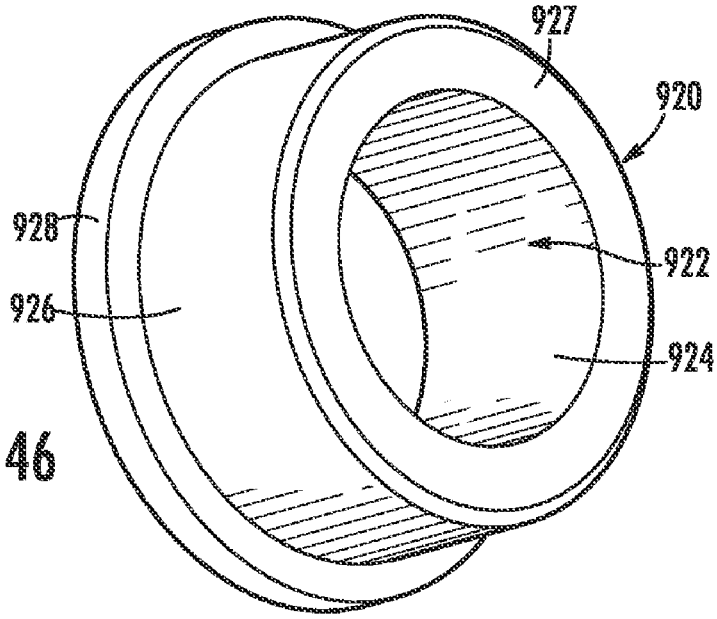
FIG. 46 is substantially a perspective view of a rotating cylinder.

Referring now to FIG. 46, a rotating cylinder 920 is shown. Rotating cylinder 920 may have a bore 922, an inner surface 924, an outer surface 926, an end 927 and a flange 928. As seen in FIGS. 39, 40A, 40B and 41, rotating cylinder 920 can be mounted over camshaft 802 between locking cam 820 and release cam 902 such that flange 928 abuts locking cam 820. End 927 extends into bore 916 and rests against annular step 914 of release cam 902. Rotating cylinder 920 allows release cam 902 to pivot and rotate around camshaft 802.

Spring 930 is coupled to release cam 902 in order to move release cam 902 and locking cam 820 to an unlocked position. Spring 930 has ends 932, 934 and coils 936. Coils 936 are disposed around outer surface 926 of rotating cylinder 920. End 932 is fastened to raised area 717 by a retainer 938 (FIG. 39). End 934 is hooked into hole 906 of release cam 902. Spring 930 biases release cam 902 to rotate clockwise in FIG. 39.

Actuation Method

When door assembly 700 is not locked, door assembly 700 opens generally the same as previously described in conjunction with FIG. 15. With reference to FIGS. 37 and 39A and B, bolt spring 748 urges bolt 750 to a first position wherein bolt 750 is configured to protrude from a door 340 and to engage door 340 with a wall by moving into a wall aperture (not shown). Door handle 730 is attached to actuator 732 with actuator tip 733. Actuator tip 733 extends into opening 756 and engages block 760. Door handle 340 is attached to mount 724 (FIG. 40A, 40B), which serves as a fulcrum allowing handle 730 to pivot around a pivot axis.

As a user pulls handle 730 toward him or her, actuator tip 733 presses on block 760 and moves bolt 750 to a second position wherein bolt 750 moves outside of a wall aperture thereby disengaging door 340 from the wall. After the user releases door handle 730, spring 748 urges bolt 750 to protrude from door 340. At the same time, door handle spring 780 causes door handle 730 to move inwardly to a position wherein door handle 730 and faceplate cap 710 defines a substantially flush and flat front surface.

Locking Method

Referring now to FIGS. 39A, 39B and 40A, cam latch 810 may be attached to camshaft 802, which may allow a user to conveniently activate locking cam 820. By pivoting cam latch 810 within a rotational axis, cam latch 810 moves camshaft 802 and locking cam 820 between a first and second position.

Locking cam 820 can be rotated from a first unlocked position shown in FIG. 40B to a second locked position shown in FIG. 40A. In FIG. 40A, locking cam 820 is rotated such that post 832 is close to bolt end 754 and is separated by a small gap 749A.

As cam latch 810 is rotated, camshaft 802 and locking cam 820 are rotated counter-clockwise. Because post 832 is engaged with arm 904 of release cam 902, release cam 902 is also rotated counter-clockwise. At the same time, tension in spring 930 will be increasing. As post 832 nears bolt end 754, post 904 and lip 905 of release cam 902 engages and locks onto projection 832 of handle 730 (best seen in FIG. 39B). Spring 930 is now fully tensioned.

In this first position locking cam 820 prevents bolt 750 from sliding inwardly and prevents door 340 from opening (FIG. 37). Thereby, door handle assembly 700 is in a locked position.

Automatic Lock Release Method

Referring now to FIGS. 39A, 39B, 40A and 40B, lock release mechanism 900 automatically unlocks door handle assembly 700 when a user pulls on door handle 730. Lock release mechanism deactivates cam assembly 800 when a user pulls on door handle 730.

When door handle assembly 700 is locked and a user pulls on door handle 730, projection 734 of actuator 732 moves away from arm 904 and lip 905 of release cam 902, thereby releasing release cam 902 (best seen in FIG. 39B). Because release cam 902 is biased by spring 930, it will start to rotate clock-wise. Post 832 of locking arm 820 is engaged with arm 904 and lip 905 of release cam 902. As release cam 902 moves clockwise, locking arm 820 will also move clock-wise. At the same time, with locking arm 820 fixed to camshaft 802, camshaft 802 and cam latch 810 will also be rotated in a clockwise manner. Lock release cam 902 and locking cam 820 will continue to rotate until arm 904 engages or abuts against a stop 723. It is noted that rotating cylinder 920 allows movement of release cam 902 independently of the position or movement of camshaft 802 or locking cam 820. Door handle assembly 700 is now in a second unlocked position where post 832 is separated from bolt end 748 by a large gap 749B (FIG. 40B). In this second unlocked position bolt 750 can be slid away from a wall aperture by further pulling of door handle 730 such that door 340 can be opened.

It is noted that while door handle 730 was described as being operated by a pulling motion, door handle 730 could also be designed such that pushing door handle 730 actuates lock release mechanism 900 and unlocks door handle assembly 700.

CONCLUSION

Although the description above contains many specifications, these should not be construed as limiting the scope of the invention but as merely providing illustrations of some of presently preferred embodiments of this invention. Thus, the scope of the invention should be determined by the appended claims and their legal equivalents rather than by the examples given.

What is claimed is:

1. A door handle assembly comprising:

(A) a door handle having an actuator extending from the door handle;

(B) a mount, the door handle being attached to the mount;

(C) a bolt, the bolt being movable from a first bolt position where at least a portion of the bolt is inside a wall aperture thereby engaging the door into the wall aperture to a second bolt position where the portion of the bolt is outside the wall aperture thereby disengaging the door from the wall aperture, the bolt having an actuator opening formed therein, the actuator passing into the actuator opening, wherein when the door handle is moved, the bolt moves from the first bolt position to the second bolt position;

(D) a cam assembly disposed adjacent to the bolt, the cam assembly comprising:

(a) a locking cam configured to abut at least a portion of the bolt and to lock the bolt in the first bolt position; and (b) a cam latch attached to one end of a cam shaft, the cam latch being adapted to allow a user to actuate the cam assembly;

wherein the cam assembly is moveable between an unlocked position and a locked position, the locked position corresponding to the bolt being located in the first bolt position; and (E) a lock release mechanism coupled with the cam assembly and configured to cause the locking cam to move from the locked position to the unlocked position, the lock release mechanism comprising:

(a) a release cam abutting the locking cam; and (b) a return spring connected to the release cam, the return spring being adapted to move the release cam and the cam assembly to the unlocked position when the door handle is moved.

2. The door handle assembly of claim 1, wherein the release cam has an arm and the door handle has a projection, the projection retaining the arm in the locked position.

3. The door handle assembly of claim 2, wherein the locking cam has a post, the post being adapted to abut the arm such that movement of the locking cam moves the release cam toward the locked position.

4. The door handle assembly of claim 1, wherein the locking cam is affixed to a cam shaft.

5. A door handle assembly comprising:

(A) a door handle;

(B) a mount, the door handle being attached to the mount;

(C) a bolt, the door handle being adapted to allow the bolt to move into and out of a wall aperture;

(D) a cam assembly disposed adjacent the bolt, the cam assembly comprising:

(a) a locking cam configured to abut at least a portion of the bolt and to lock the bolt in a locked position; and (b) a cam latch attached to one end of a cam shaft, the cam latch being adapted to allow a user to actuate the cam assembly;

wherein the locking cam is moveable between the locked position and an unlocked position; and (E) a lock release mechanism coupled to the cam assembly and to the door handle and configured to disengage the locking cam from the bolt when the door handle is actuated such that the bolt is free to move, the lock release mechanism comprising:

(a) a release cam coupled with the locking cam and the door handle; and (b) a return spring connected between the release cam and the mount, the return spring being adapted to urge the locking cam toward the unlocked position.

6. The door handle assembly of claim 5, wherein the door handle is a pull door handle.

7. The door handle assembly of claim 6, wherein a spring is mounted with the bolt for urging the bolt into the door aperture.

8. The door handle assembly of claim 5, wherein the release cam has an arm and the door handle has a projection, the projection retaining the arm in the locked position.

9. The door handle assembly of claim 8, wherein the locking cam has a post, the post being adapted to contact the arm such that movement of the locking cam moves the release cam toward the locked position.

10. The door handle assembly of claim 5, wherein a cylinder is mounted between a camshaft and the release cam.

11. The door handle assembly of claim 5, wherein the locking cam is affixed to a cam shaft.

12. A door assembly comprising:

(A) door handle means for opening and closing a door;

(B) bolt means for selectively engaging a door frame, the bolt means being movable from a locked first bolt position where the bolt means engages a door frame aperture to an unlocked second bolt position where the bolt means is retracted from the door frame aperture, the door handle means being adapted to selectively engage the bolt means;

(C) cam means for locking the bolt means in the locked first bolt position; and (D) lock release means for releasing the cam means from the locked first bolt position to the unlocked second bolt position, thereby unlocking the bolt means.

13. The door assembly of claim 12, further comprising: mount means for connecting the door handle means to a door.

14. The door assembly of claim 12, wherein the cam means further comprises:

a cam shaft having a first and second end;

a locking cam attached to the first end, the locking cam being adapted to engage the bolt means;

a cam latch attached to the second end, the cam latch being adapted to allow a user to actuate the cam means.

15. The door assembly of claim 12, wherein the lock release means further comprises:

a release cam;

a return spring connected to the release cam.

16. The door assembly of claim 15, wherein the release cam has an arm and the door handle means has a projection, the projection retaining the arm when the bolt means is locked in the first bolt position.

17. The door handle assembly of claim 16, wherein the locking cam has a post, the post being adapted to contact the arm such that movement of the locking cam moves the release cam.

18. The door assembly of claim 12, wherein the door handle means are pull door handle means.

19. The door assembly of claim 12, wherein the door handle means are push door handle means.

* * * * *